US009341056B2

(12) United States Patent
Weightman et al.

(10) Patent No.: US 9,341,056 B2
(45) Date of Patent: May 17, 2016

(54) DISCHARGE PRESSURE MONITORING SYSTEM

(71) Applicant: Halliburton Energy Services, Inc., Houston, TX (US)

(72) Inventors: Glenn H. Weightman, Duncan, OK (US); Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 438 days.

(21) Appl. No.: 13/720,749

(22) Filed: Dec. 19, 2012

(65) Prior Publication Data

US 2014/0166268 A1 Jun. 19, 2014

(51) Int. Cl.

| | |
|---|---|
| ***F04B 23/04*** | (2006.01) |
| ***F04B 49/06*** | (2006.01) |
| ***E21B 47/06*** | (2012.01) |
| ***E21B 33/13*** | (2006.01) |
| ***E21B 43/26*** | (2006.01) |
| ***F04B 47/00*** | (2006.01) |

(52) U.S. Cl.

CPC ..... *E21B 47/06* (2013.01); *E21B 33/13* (2013.01); *E21B 43/26* (2013.01); *F04B 47/00* (2013.01)

(58) Field of Classification Search

CPC ..... E21B 43/12; E21B 21/08; E21B 43/26; F04B 2207/70; F04B 23/04; F04B 49/065; F04B 49/06; F04B 2205/01; F04B 2205/02; F04B 2205/04; F04B 2205/05

USPC ..... 166/250.01, 66, 105

See application file for complete search history.

(56) References Cited

U.S. PATENT DOCUMENTS

| | | | | |
|---|---|---|---|---|
| 3,229,639 | A * | 1/1966 | Hignutt | G05D 16/2073 417/12 |
| 3,511,579 | A * | 5/1970 | Gray et al. | 417/6 |
| 3,971,926 | A * | 7/1976 | Gau | E21B 21/08 175/50 |
| 4,302,157 | A * | 11/1981 | Welton et al. | 417/12 |

(Continued)

FOREIGN PATENT DOCUMENTS

| | | | |
|---|---|---|---|
| GB | 2419671 | A | 5/2006 |
| WO | 2014099551 | A2 | 6/2014 |

OTHER PUBLICATIONS

Filing receipt and specification for patent application entitled "Suction Pressure Monitoring System," by Glenn H. Weighman, et al., filed Dec. 19, 2012 as U.S. Appl. No. 13/720,729.

(Continued)

*Primary Examiner* — Kenneth L Thompson

(74) *Attorney, Agent, or Firm* — John W. Wustenberg; Baker Botts L.L.P.

(57) ABSTRACT

A pressure monitoring method comprising providing wellbore servicing equipment comprising a pump, a discharge flow path configured to discharge fluid from the pump, a discharge pressure monitoring system comprising a transducer in pressure communication with the discharge flow path, and an electronic circuit in electrical communication with the transducer and a monitoring system, collecting an electrical signal indicative of the pressure within the discharge flow path, processing the electrical signal to generate an upper pressure envelope signal, wherein the upper pressure envelope signal is representative of a high pressure within the discharge flow path over a predetermined duration of time, and comparing the upper pressure envelope signal to a predetermined upper threshold.

11 Claims, 7 Drawing Sheets

(56) References Cited

U.S. PATENT DOCUMENTS

| | | | | |
|---|---|---|---|---|
| 4,766,329 | A * | 8/1988 | Santiago | G05D 9/12 307/116 |
| 5,720,598 | A | 2/1998 | de Chizzelle | |
| 5,846,056 | A * | 12/1998 | Dhindsa et al. | 417/44.2 |
| 6,709,241 | B2 * | 3/2004 | Sabini et al. | 417/53 |
| 6,859,740 | B2 * | 2/2005 | Stephenson et al. | 702/35 |
| 6,904,982 | B2 * | 6/2005 | Judge et al. | 175/213 |
| 7,353,875 | B2 * | 4/2008 | Stephenson et al. | 166/305.1 |
| 7,819,024 | B1 | 10/2010 | Lucas et al. | |
| 7,832,257 | B2 | 11/2010 | Weightman et al. | |
| 8,122,759 | B2 | 2/2012 | Weightman et al. | |
| 8,543,245 | B2 * | 9/2013 | Heitman et al. | 700/282 |
| 8,622,713 | B2 * | 1/2014 | Hampton | F04B 49/065 417/212 |
| 8,807,960 | B2 * | 8/2014 | Stephenson et al. | 417/216 |
| 2004/0167738 | A1 | 8/2004 | Miller | |
| 2010/0027371 | A1 | 2/2010 | Lucas et al. | |
| 2011/0202275 | A1 | 8/2011 | Beisel et al. | |
| 2014/0166267 | A1 | 6/2014 | Weightman et al. | |

OTHER PUBLICATIONS

Foreign communication from a related counterpart application—International Search Report and Written Opinion, PCT/US2013/074396, Sep. 15, 2014, 11 pages.

Foreign communication from a related counterpart application—International Search Report and Written Opinion, PCT/US2013/074407, Aug. 29, 2014, 11 pages.

Spoerker, H. F., et al., "High-Frequency Mud Pump Pressure Monitoring Enables Timely Wear Detection," IADC/SPE 77234, 2002, pp. 1-16, IADC/SPE Asia Pacific Drilling Technology.

International Preliminary Report on Patentability issued in related PCT application No. PCT/US2013-074396, mailed on Jul. 2, 2015 (8 pages).

* cited by examiner

DISCHARGE PRESSURE MONITORING SYSTEM

CROSS-REFERENCE TO RELATED APPLICATIONS

The subject matter of this application is related to U.S. patent application Ser. No. 13/720,729 filed on 12/19/2012 and entitled "Suction Pressure Monitoring System," the entire disclosure of which is incorporated herein by this reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbore servicing systems and equipment may include a variety of pumps, which require maintenance over time. With conventional maintenance strategies, such as exception-based and periodic checking, faults which have developed in pumps have to be detected by human experts through physical examination and other off-line tests (e.g. metal wear analysis), for example, during a routine maintenance check-up in order for corrective action to be taken. Faults that go undetected during a regular maintenance check-up may lead to breakdowns and unscheduled shutdown of the wellbore servicing operation. The probability of an unscheduled shutdown increases as the time period between successive maintenance inspections increases. The frequency of performing maintenance, however, maybe limited by availability of manpower and financial resources and, hence, is not easily increased. Some maintenance inspections, such as a valve, plunger, or packing inspection may require stopping the process or even disassembling machinery. In addition, the lost production time (i.e., time "off-line") may cost as much as, often many times more, than the labor cost involved with such inspections. There is also a possibility that the reassembled machine may fail due to an assembly error or high start-up stresses, for example. Finally, periodically replacing components (e.g., as a part of a routine preventative maintenance program) such as bearings, seals, or valves is costly since the service life of good components may unnecessarily be cut short.

When problems or faults are encountered, for example, if a valve becomes stuck and unable to operate properly and/or to relieve internal pressure then over-pressuring can occur within the wellbore servicing system. In particular, an over-pressure can cause the pressure within one or more components of the wellbore servicing equipment to rapidly increase beyond acceptable tolerances. A rapid increase in internal pressure can cause significant damage to the wellbore servicing equipment and can create a significant health hazard to wellbore servicing equipment operators. As a result of an over-pressure, permanent damage can occur to the wellbore servicing equipment. For example, over-pressure can cause accelerated wear and deterioration to the internal surfaces and seals of one or more pumps. When an over-pressure event occurs the wellbore servicing operations may be suspended until the scope of damage can be assessed and/or the cause can be determined. Conventional devices, systems, and methods are insufficient to monitor the conditions prior to an event.

As such, devices, systems, and methods allowing for avoidance of such events can help to avoid over-pressure induced damage to pumps and/or other wellbore servicing equipment and may facilitate extended wellbore up time.

SUMMARY

Disclosed herein is a pressure monitoring method comprising providing wellbore servicing equipment comprising a pump, a discharge flow path configured to discharge fluid from the pump, a discharge pressure monitoring system comprising a transducer in pressure communication with the discharge flow path, and an electronic circuit in electrical communication with the transducer and a monitoring system, collecting an electrical signal indicative of the pressure within the discharge flow path, processing the electrical signal to generate an upper pressure envelope signal, wherein the upper pressure envelope signal is representative of a high pressure within the discharge flow path over a predetermined duration of time, and comparing the upper pressure envelope signal to a predetermined upper threshold.

Also disclosed herein is a wellbore servicing system comprising a pump, a discharge flow path configured to discharge fluid from the pump, a discharge pressure monitoring system comprising a transducer in pressure communication with the discharge flow path, and an electronic circuit in electrical communication with the transducer and a monitoring system, wherein the electronic circuit is configured to generate an upper pressure envelope signal, wherein the upper pressure envelope signal is representative of a high pressure within the discharge flow path over a predetermined duration of time.

Further disclosed herein is a pressure monitoring method comprising providing a discharge flow path from a pump, collecting an electrical signal indicative of the pressure within the discharge flow path, processing the electrical signal to generate an upper pressure envelope signal, wherein the upper pressure envelope signal is representative of a high pressure within the discharge flow path over a predetermined duration of time, monitoring upper pressure envelope signal, and responding when the upper pressure envelope signal exceeds a predetermined upper threshold.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
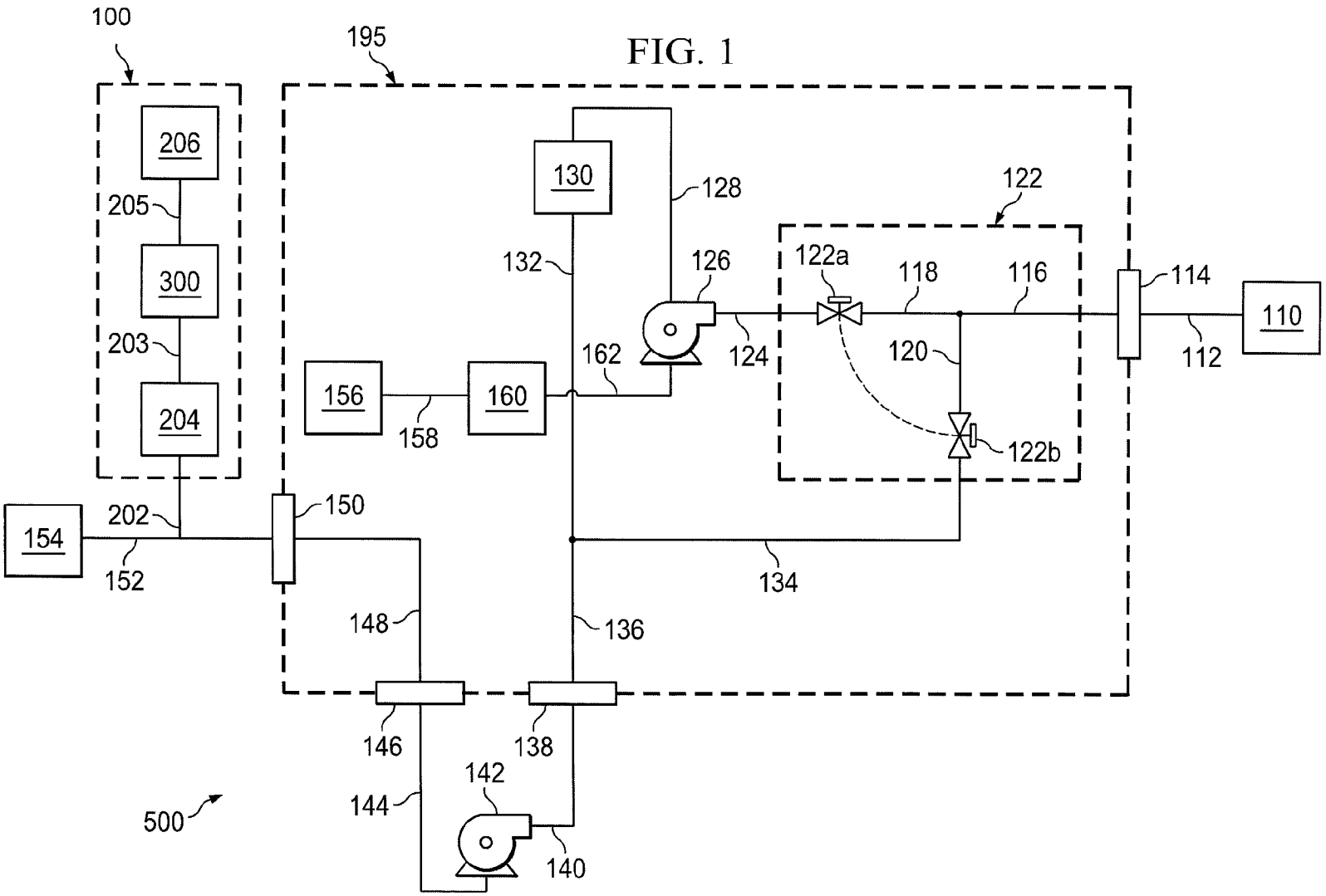
FIG. 1 is a schematic view of an embodiment of components associated with a wellbore services manifold trailer.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of a discharge pressure monitoring system (DPMS), a wellbore servicing system comprising a DPMS, and methods of using the same. In an embodiment, a DMPS may be employed to monitor the pressure of a fluid pumped into a wellhead during a wellbore servicing operation. In an embodiment, a DPMS may provide the ability to detect and/or track relatively fast transient events (e.g., pressure peaks or spikes). For example, in an embodiment, the DPMS may be employed to monitor and/or to initiate a response during events, such as over-pressuring, thereby protecting wellbore servicing equipment and/or wellbore servicing equipment operators.

Referring to FIG. 1, an embodiment of an operating embodiment of a DPMS is illustrated. In an embodiment, the operating environment generally comprises a well site associated with a wellbore.

In the embodiment of FIG. 1, the operating environment comprises a servicing system 500 comprising one or more wellbore servicing operating equipment components generally positioned at the well site and which may be attached to a wellhead 154 of the wellbore, for example, for performing one or more wellbore servicing operations, as will be disclosed herein. Examples of such wellbore servicing operations may include, but are not limited to, fracturing operations, acidizing operations, cementing operations, enhanced oil recovery operations, carbon dioxide injections operations, completion operations, fluid loss operations, well-kill operations, and combination thereof. For example, fracturing operations are treatments performed on wells in low-permeability reservoirs. During fracturing operations, fluids are pumped at high-pressure into the low-permeability reservoir interval to be treated, causing a fracture to open within the formation. Proppants, such as grains of sand, are mixed with the fluid to keep the fracture open when the treatment is complete. Not intending to be bound by theory, hydraulic fracturing may create high-conductivity communication within a large area of the formation. In an alternative example, cementing operations may comprise cementing an annulus after a casing string has been run, cementing a lost circulation zone, cementing a void or a crack in a conduit, cementing a void or a crack in a cement sheath disposed in an annulus of a wellbore, cementing an opening between the cement sheath and the conduit, cementing an existing well from which to push off with directional tools, cementing a well so that it may be abandoned, and/or the like. In an alternative example, a wellbore servicing operation may also comprise enhancing oil recovery operations such as by injecting carbon dioxide into a reservoir to increase production such as by reducing oil viscosity and/or providing miscible or partially miscible displacement of the oil.

In an additional or alternative embodiment, one or more fluids may be introduced into the wellbore to prevent the loss of aqueous or non-aqueous fluids (e.g., drilling fluids) into lost-circulation zones such as voids, vugular zones, and natural or induced fractures while drilling. Additionally or alternatively, in an embodiment, one or more fluids may form a non-flowing, intact mass with good strength and may be capable of withstanding the hydrostatic pressure inside the lost-circulation zone. In such an embodiment, the one or more fluids may plug the zone and inhibit the loss of subsequently pumped drilling fluids, thus allowing for further drilling.

In the embodiment of FIG. 1, the wellbore servicing equipment 500 may generally comprise various wellbore servicing equipment components including, but not limited to, one or more blenders 110, a wellbore services manifold trailer 195, one or more high-pressure pumps 142, or combinations thereof.

In the embodiment, of FIG. 1, the wellbore servicing system 500 is configured such that the blender 110 delivers a wellbore fluid to the wellbore services manifold trailer 195, which delivers the wellbore fluid to one or more high pressure pumps 142 for pressurization and delivery into the wellbore via the wellhead 154. While FIG. 1 illustrates a particular embodiment of an operating environment in which a DPMS may be employed and/or a particular configuration of wellbore servicing equipment components with which a DPMS may be associated, one of ordinary skill in the art, upon viewing this disclosure, will appreciate that a DPMS as will be disclosed herein may be similarly employed in alternative operating environments and/or alternative configurations of wellbore servicing equipment.

In an embodiment, the blender 110 may mix solids and fluid components at a desired treatment rate to achieve a well-blended mixture (e.g., a wellbore servicing fluid, completion fluid, or the like, such as a fracturing fluid, cement slurry, liquefied inert gas, etc.). Examples of such fluids and solids include proppants, water, chemicals, cement, cement additives, or various combinations thereof. The mixing conditions including time period, agitation method, pressure, and temperature of the blender may be chosen by one of ordinary skill in the art to produce a substantially homogenous blend of the desired composition, density, and viscosity and/or to otherwise meet the needs of the desired wellbore operation. In an embodiment, the blender 110 may comprise a tank constructed from a metal plate, composite materials, or any other material. Additionally, in an embodiment, the blender 110 may further comprise a mixer or agitator that mixes or agitates the components of fluid within the blender 110. In an embodiment, the blender 110 may also be configured with heating or cooling devices to regulate the temperature within the blender 110. Alternatively, the fluid may be premixed and/or stored in a storage tank before entering the wellbore services manifold trailer 195.

In an alternative embodiment, the blender 110 may further comprise a storage tank for an injection operation. In such an embodiment, the blender 110 may store a fluid to be injected downhole. In an embodiment, the fluid may comprise liquefied carbon dioxide, nitrogen, or any other liquefied inert gas.

Figure 2:
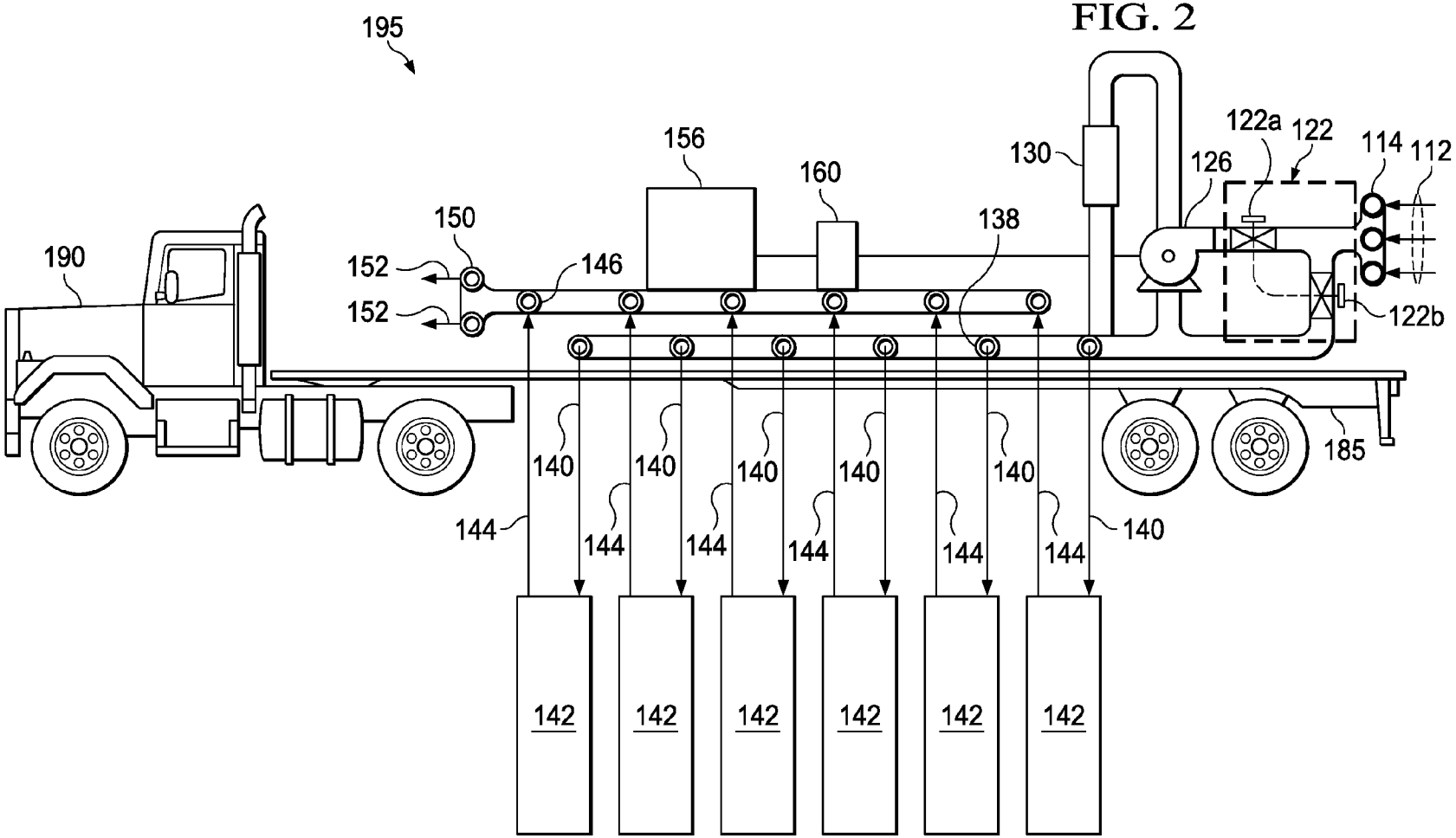
FIG. 2 is a side view of an embodiment of a wellbore services manifold trailer.

Referring to FIG. 2, an embodiment of a wellbore services manifold trailer 195 is illustrated. In an embodiment, the wellbore services trailer 195 may generally comprise a truck or prime 190, a trailer bed 185 comprising one or more manifolds for receiving, organizing, and/or distributing wellbore servicing fluids during wellbore servicing operations, a plurality of connectors, a bypass valve assembly 122, a boost pump 126, a flowmeter 130, power source 156, and a hydraulic control system 160. In an embodiment, the wellbore servicing manifold trailer 195 may comprise a plurality of blender connectors 114, for example, which may be located towards the back end near the axle of the trailer bed 185 and may be connected to one or more blenders 110. Additionally, in an embodiment, the wellbore servicing manifold trailer 195 may also comprise a plurality of high-pressure pump suction connectors 138 (e.g., fluid outlets), for example, which may be located along the sides of the trailer bed 185 and arranged in parallel to each other. Also, in such an embodiment, the high-pressure pump suction connectors 138 may be connected via a plurality of flowlines to the plurality of high-pressure pumps 142 and the high-pressure pumps 142 are then connected via a plurality of flowlines to a plurality of high-pressure pump discharge connectors 146 (e.g., fluid inlets), for example, which may be located along the sides of the trailer bed 185 and arranged in parallel as well, as illustrated in FIG. 2.

It is noted that the term "flowline" may generally refer to a generally tubular structure with an axial flowbore, for example, a tubing, hosing, piping, conduit, or any other suitable devices for communicating a fluid and/or a gas as would be appreciated by one of skill in the art. Additionally, in various embodiments, a flowline may comprise suitable terminal connections allowing two or more flowlines to form a common flowbore and/or to interact with other components. For example, a flowline may be joined with another component via mating structure, such as an internally and/or externally threaded connection.

In an embodiment, the wellbore services manifold trailer 195 may comprise the bypass valve assembly 122 which may comprise one or more valves (e.g., a first valve 122*a* and a second valve 122*b*). In such an embodiment, the bypass valve assembly 122 may be selectively configurable to establish one or more routes of fluid communication (e.g., a route via the first valve 122*a* or a route via the second valve 122*b*).

Referring to FIG. 1, in an embodiment, the blender connection 114 of the wellbore services manifold trailer 195 may be in fluid communication with the bypass valve assembly 122. For example, the blender connection 114 may be in fluid communication with the first valve 122*a* via a route formed by a flowline 116 and a flowline 118. Additionally, in such an embodiment, the blender connection 114 may be in fluid communication with the second valve 122*b* via a route form by the flowline 116 and a flowline 120. In an embodiment, the first valve 122*a* may be configured to form a path between the flowline 118 and a flowline 124. In such an embodiment, the first valve 122*a* is in fluid communication with the boost pump 126 via the flowline 124. Also, in such an embodiment, the boost pump 126 may be in fluid communication with the flow meter 130 via a flowline 128. Additionally, the flowmeter 130 may be in fluid communication with the high-pressure pump suction connector 138 via the flowline 132 and a flowline 136. Alternatively, the second valve 122*b* may be configured to form a path between the flowline 120 and a flowline 134, thereby bypassing the boost pump 126 and the flowmeter 130. In such an embodiment the second valve 122*b* is in fluid communication with the high-pressure pump suction connector 138 via the flowline 134 and the flowline 136. Additionally, in an embodiment, the high-pressure discharge connector 146 may be in fluid communication with the well head connector 150 via flowline 148.

In an embodiment, a flowmeter 130 may be configured such that a fluid enters the flowmeter 130 via the flowline 128 and the fluid may exit the flowmeter via the flowline 132. Also in such an embodiment, the flowmeter 130 may be configured to measure the velocity of the fluid. For example, in an embodiment, the flowmeter 130 may be a piston meter, a woltmann meter, a venture meter, an orifice plate, a pitot tube, a paddle wheel, a turbine flowmeter, a vortexmeter, a magnetic meter, an ultrasound meter, a coriolis, a differential-pressure meter, a multiphase meter, a spinner flowmeter, a torque flowmeter, and a crossrelation flowmeter.

In an embodiment, the boost pump 126 may be configured such that a fluid enters via the flowline 124. In such an embodiment, the boost pump 126 may be configured to increase the pressure of the fluid to a second pressure threshold which may be greater than the first pressure threshold. In an embodiment, the boost pump 126 may be any type of pump, for example, a Mission Sandmaster 10×8 centrifugal pump or an API 610 centrifugal pump. In an alternative embodiment, the boost pump 126 may be configured to pump an inert compressed or liquefied gas. In such an embodiment, some components (e.g., connectors) of the boost pump 126 may be modified to meet the needs for the inert compressed or liquefied gas.

Additionally, in an embodiment, the flow from the centrifugal pump may be controllable, for example, the boost pump 126 may be controlled by the hydraulic control system 160, as will be disclosed herein.

In an embodiment, the wellbore services manifold trailer 195 may further comprise the power source 156, for example, a diesel engine such as a commercially available 520 hp Caterpillar C13. In an embodiment, the power source 156 may be configured to power other equipment around the wellbore services manifold trailer 195 requiring power that may be useful to and/or appreciated by one of ordinary skill in the art.

Additionally, the wellbore services manifold trailer 195 may comprise the hydraulic control system 160. In an embodiment, the power system 156 may be coupled to the hydraulic control system 160 via an electrical connection 158 and the hydraulic control system 160 is coupled to the boost pump via the flow line 162. For example, in an embodiment, a hydraulic control system 160 may comprise a hydrostatic transmission system comprising a Sundstrand variable displacement axial piston hydraulic pump with electric displacement control, a Volvo Hydraulics fixed displacement motor, a Barnes hydraulic gear pump, a plurality of hydraulic components (e.g., oil reservoirs, oil coolers, hoses, and fittings), a pressure transducer to monitor pressure, a computer, and software. For example, in an embodiment, the computer may be configured to send an electric signal to the Sundstrand variable displacement axial piston hydraulic pump to change the amount of hydraulic oil pumped, thus causing the flow rate or a pressure change of the Volvo Hydraulic fixed displacement motor and the boost pump 126. Additionally, in such an embodiment, the hydraulic control system 160 may be employed to actuate the bypass valve assemble 122.

In an embodiment, the wellbore servicing system 500 may comprise a plurality of pumps 142 and may be configured to increase the fluid pressure to a high-pressure suitable for injection into the wellbore. For example, in an embodiment, the plurality of high-pressure pumps 142 may be a positive displacement pump, for example, a Haliburton HT-400 Pump. In an embodiment, the plurality of high-pressure pumps 142 may be configured such that a fluid entersvia the flowline 140 and the fluid exits the plurality of high-pressure pumps 142 via the flowline 144 to the wellbore services manifold trailer 195. In an embodiment, the plurality of high-pressure pumps 142 may be configured increase the pressure of the fluid from a second threshold of pressure to a third pressure threshold. In such an embodiment, the third pressure threshold is greater than the second threshold.

In an embodiment, the DPMS 100 may generally comprise a transducer 204, an electronic circuit 300, and a monitoring system 206. Although the embodiment of FIG. 1 illustrates a DPMS 100 comprising multiple distributed components (e.g., a single transducer 204, a single electronic circuit 300, and a monitoring equipment 206, each of which comprises a separate, distinct component), in an alternative embodiment, a similar DPMS may comprise similar components in a single, unitary component (e.g., housed on a common circuit board, electronic bus, etc.); alternatively, the functions performed by these components (e.g., the transducer 204, the electronic circuit 300, and the monitoring equipment 206) may be distributed across any suitable number and/or configuration of like componentry, as will be appreciated by one of ordinary skill in the art with the aid of this disclosure.

In an embodiment, a DPMS 100 may be in fluid communication with a flow path through the wellbore servicing system 500. Particularly, the DPMS 100 is in fluid communication with a portion of the flow path (e.g., flowline 144, 148, and/or 152) comprising a fluid exit side (e.g., discharge side) of a pump (e.g., one or more of the high-pressure pumps 142). While FIG. 1 illustrates a single DPMS 100 in communication with a fluid exit side of a single pump, in an alternative embodiment, a similar DPMS may be in communication with the fluid exit side of a plurality of pumps; alternatively, in an embodiment, multiple DPMS may each be in communication with the fluid exit side of one or more pumps.

In an embodiment (for example, in the embodiment of FIG. 1 where the transducer 204, the electronic circuit 300, and the monitoring equipment 206 comprise distributed components) the electronic circuit 300 may communicate with the transducer 204 and/or the monitoring equipment 206 via a suitable signal conduit, for example, via one or more suitable wires. In an additional or alternative embodiment, for example, the DPMS 100 may also communicate with the hydraulic control system 160 via a suitable conduit. Examples of suitable wires include, but are not limited to, insulated solid core copper wires, insulated stranded copper wires, unshielded twisted pairs, fiber optic cables, coaxial cables, any other suitable wires as would be appreciated by one of ordinary skill in the art, or combinations thereof. In alternative embodiments, one or more components described herein may communicate wirelessly, for example, via a suitable wireless protocol (e.g., IEEE 802.11, etc.).

In an embodiment, the DPMS 100 may comprise any suitable type and/or configuration of transducer 204. In an embodiment, the transducer 204 may be configured to measure the pressure within the a discharge flowline associated with a pump, for example, so as to measure the pressure within one or more of the flowlines 144, 148, and 152 associated with the high-pressure pump 142, as disclosed herein. Suitable types and/or configurations may include, but are not limited to, capacitive sensors, piezoresistive strain gauge sensors, electromagnetic sensors, piezoelectric sensors, optical sensors, or combinations thereof. In such embodiments, the transducer 204 may comprise a single ended physical output or a differential physical output. In an embodiment, the transducer 204 is capable of sensing a pressure and/or pressure changes, for example, pressure changes within a discharge side of a pump, at a suitable resolution to be measured and/or sampled by an electronic circuit, as will be disclosed herein.

In an embodiment, the transducer 204 may be configured to output a suitable signal, for example, which may be proportional to the measured sensed pressure. For example, in an embodiment, the transducer 204 may be configured to convert the measured applied pressure to a suitable representative electronic signal. In an embodiment, the suitable electronic signal may comprise a varying analog voltage or current signal proportional to a measured force applied to the transducer 204. For example, the electrical signal may comprise an analog voltage signal varying from about 0 volts (V) to about 1 mV or may comprise an analog current signal varying from about 4 milliamps (mA) to about 20 mA. In an alternative embodiment, the electrical signal may comprise an analog voltage signal varying from about 0 V to about 1 V, alternatively, from about 1 V to about 5 V, alternatively, from about −5 V to about 5 V, alternatively, from about 0 V to about 10 V, alternatively, from about −10 V to about 10 V, alternatively, any other suitable voltage range as would be appreciated by one of ordinary skill in the art upon viewing this disclosure. In an alternative embodiment, the suitable electronic signal may comprise a digital encoded voltage signal in response to a measured force sensed to the transducer 204.

In an embodiment, the transducer 204 may be configured to detect the amount of strain on a force collector due to an applied pressure and to output an electrical signal indicative of the applied pressure. In an alternative embodiment, the transducer 204 may comprise an inductive sensor and may be configured to detect a variations in inductance and/or in an inductive coupling of an internal moving core due to the applied pressure onto a linear variable differential transformer and to output an electrical signal indicative of the applied pressure. In another alternative embodiment, the transducer 204 may comprise a piezoelectric member configured to convert a stress (e.g., due to an applied pressure onto the piezoelectric member) into an electrical potential and to output the electrical signal indicative of the applied pressure. In an alternative embodiment, the transducer 204 may comprise any other suitable sensor as would be appreciated by one of ordinary skill in the arts upon viewing this disclosure. Additionally, in an embodiment the transducer 204 may further comprise additional circuitry components (e.g., a voltage amplifier) as an electrical interface and/or any other suitable components, as would be appreciated by one of ordinary skill in the arts.

In an embodiment, the transducer 204 may be positioned within (e.g., in fluid communication with a flow path of) a discharge flow path, for example, flowline 152 such that the transducer 204 may sense and/or measure the pressure within the discharge flow path of the high-pressure pump 142. In an alternative embodiment, the transducer 204 may be positioned within an ancillary flowline 202 which may be in fluid and/or pressure communication with the discharge flow path, for example, flowline 152 of the high-pressure pump 142.

In an additional or alternative embodiment, the wellbore services manifold trailer 195 may comprise a plurality of transducers 204. For example, in an embodiment, a plurality of transducers may be positioned within fluid and/or pressure communication with the discharge flow path of one or more boost pumps 126 and/or one or more high-pressure pumps 142. In an alternative embodiment, a transducer may be positioned within a common discharge flow path (e.g., a manifold) for a plurality of pumps and may be in fluid and/or pressure communication with the plurality of pumps.

In an embodiment, the electronic circuit 300 and may be configured to receive an electrical signal from the transducer 204 (e.g., pressure data). For example, the electronic circuit 300 may be used to filter and/or to process pressure data obtained by the transducer 204. In such an embodiment, the electronic circuit 300 may be in signal communication with the transducer 204, for example, via an electrical connection 203.

In an embodiment, the electronic circuit 300 may be configured to receive an electrical signal (e.g., which may be indicative of the pressure within the discharge flow path) from the transducer 204 and to generate one or more output signals, for example, based upon the pressure data received from the transducer 204. In such an embodiment, the output signals generated by the electronic circuit 300 may comprise, for example, a buffered signal, an averaged signal, a buffered upper envelope signal, a filtered upper envelope, a filtered lower envelope signal, a differential signal, and/or any other suitable signal as would be appreciated by one of ordinary skill in the art, or combination thereof. Additionally or alternatively, in an embodiment, the electronic circuit 300 may communicate with the transducer 204 and/or the monitoring equipment 206 via a suitable signaling protocol. Examples of such protocol include, but are not limited to, an encoded digital signal.

In an embodiment, the electronic circuit 300 may comprise any suitable configuration, for example, comprising one or more printed circuit boards, one or more integrated circuits, a one or more discrete circuit components, one or more active devices, one or more passive devices, one or more microprocessors, one or more microcontrollers, one or more wires, an electromechanical interface, a power supply and/or any combination thereof. As previously disclosed, the electronic circuit 300 may comprise a single, unitary, or non-distributed component capable of performing the function disclosed herein; alternatively, the electronic circuit 300 may comprise a plurality of distributed components capable of performing the functions disclosed herein.

Figure 3:
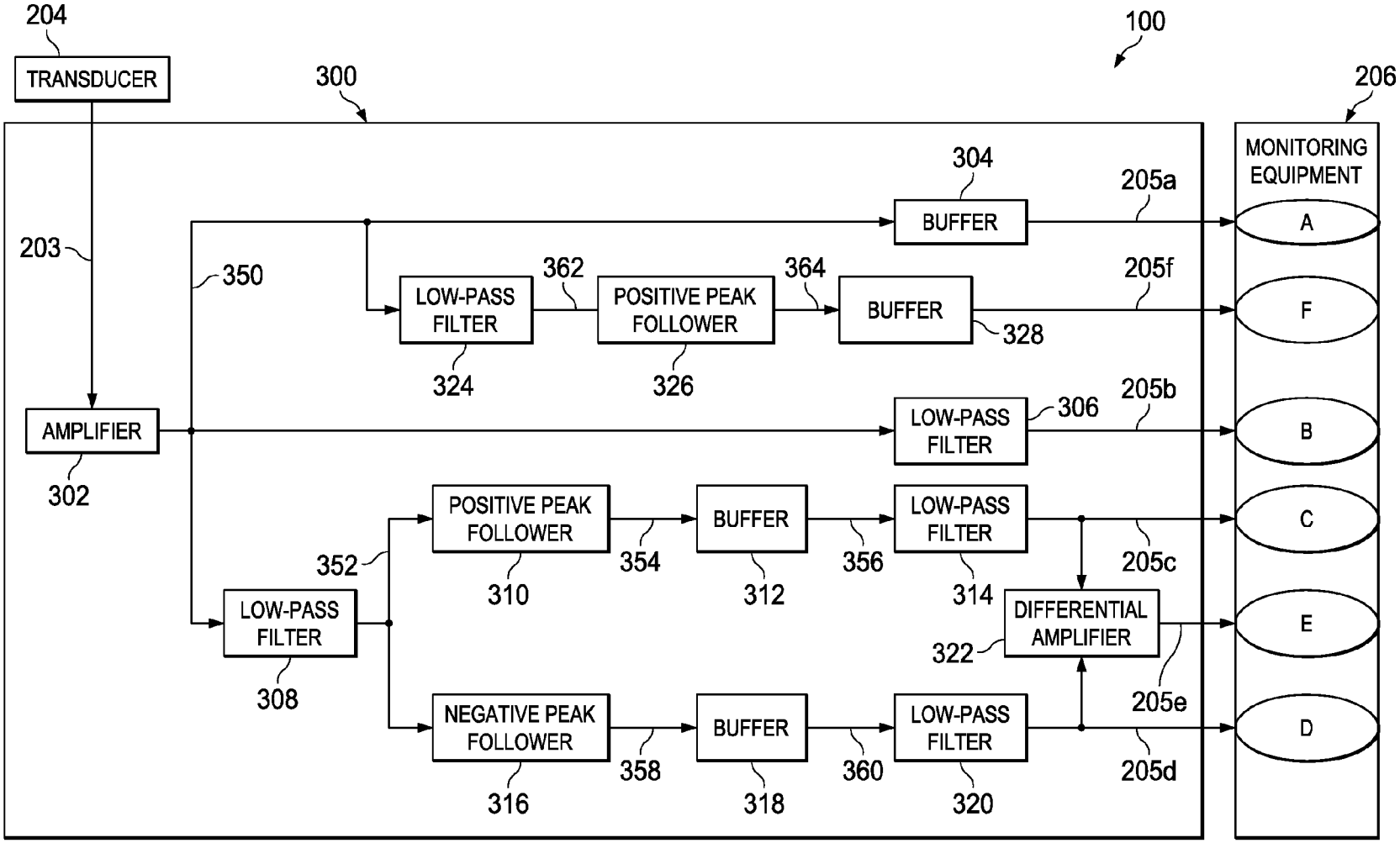
FIG. 3 is a partial flow chart of an embodiment of an electronic circuit implementation of a discharge pressure monitoring system.

In an embodiment as illustrated in FIG. 3, the electronic circuit 300 may comprise a plurality of functional units. In an embodiment, a functional unit (e.g., an integrated circuit (IC)) may perform a single function, for example, serving as an amplifier or a buffer. Additionally or alternatively, in an embodiment, the functional unit may perform multiple functions (e.g., on a single chip). In an embodiment, the functional unit may comprise a group of components (e.g., transistors, resistors, capacitors, diodes, and/or inductors) on an IC which may perform a defined function. In an embodiment, the functional unit may comprise a specific set of inputs, a specific set of outputs, and an interface (e.g., an electrical interface, a logical interface, and/or other interfaces) with other functional units of the IC and/or with external components. In some embodiments, the functional unit may comprise repeat instances of a single function (e.g., multiple flip-flops or adders on a single chip) or may comprise two or more different types of functional units which may together provide the functional unit with its overall functionality. For example, a microprocessor may comprise functional units such as an arithmetic logic unit (ALU), one or more floating point units (FPU), one or more load or store units, one or more branch prediction units, one or more memory controllers, and other such modules. In some embodiments, the functional unit may be further subdivided into component functional units. For example, in an embodiment, a microprocessor as a whole may be viewed as a functional unit of an IC, for example, if the microprocessor shares circuit with at least one other functional unit (e.g., a cache memory unit).

In some embodiments, the functional unit may comprise, for example, a general purpose processor, a mathematical processor, a state machine, a digital signal processor, a video processor, an audio processor, a logic unit, a logic element, a multiplexer, a demultiplexer, a switching unit, a switching element an input/output (I/O) element, a peripheral controller, a bus, a bus controller, a register, a combinatorial logic element, a storage unit, a programmable logic device, a memory unit, a neural network, a sensing circuit, a control circuit, a digital to analog converter, an oscillator, a memory, a filter, an amplifier, a mixer, a modulator, a demodulator, and/or any other suitable devices as would be appreciated by one of ordinary skill in the art.

In an embodiment, the electronic circuit 300 may generally comprise one or more amplifiers, one or more low-pass filters, one or more buffers, one or more positive peak followers, one or more negative peak followers, one or more differential amplifiers, and/or any other suitable components as would be appreciated by one of ordinary skill in the art.

In the embodiment of FIG. 3, the electronic circuit 300 is generally configured such that the output of the transducer 204 may be electrically connected to the input of an amplifier 302 via the electrical connection 203. In such an embodiment, the output of the amplifier 302 may be electrically connected to the input of a first buffer 304 and to the input of a first low-pass filter 306 via an electrical connection 350. Optionally, the output of the amplifier 302 may be electrically connected to the input of a third low-pass filter 308 via the electrical connection 350. In an embodiment, the output of the first buffer 304 may be electrically connected and/or interfaced with other internal and/or external circuitry via an electrical connection 205*a*. In an embodiment, the output of the first buffer 304 may be electrically connected to the input of a second low-pass filter 324 via the electrical connection 205*a*. Also, in such an embodiment, the output of the second low-pass filter 324 may be electrically connected to the input of a first positive peak follower 326 via an electrical connection 362. Also, in such an embodiment, the output of the first positive peak follower 326 may be electrically connected to the input of a second buffer 328 via an electrical connection 364. Additionally, in such an embodiment, the output of the second buffer 328 may be electrically connected and/or interfaced with other internal and/or external circuitry via an electrical connection 205*f*. Also, in an embodiment, the output of the first low-pass filter 306 may be electrically connected and/or interfaced with other internal and/or external circuitry via an electrical connection 205*b*. Additionally, in such an embodiment, the output of the third low-pass filter 308 may be electrically connected to the input of a second positive peak follower 310 and to the input of a negative peak follower 316 via an electrical connection 352. In an embodiment, the output of the second positive peak follower 310 may be electrically connected to the input of a third buffer 312 via an electrical connection 354. Also in such an embodiment, the output of the third buffer 312 may be electrically connected to the input of a fourth low-pass filter 314 via an electrical connection 356. Additionally in such an embodiment, the output of the fourth low-pass filter 314 may be electrically connected to a first input of a differential amplifier 322 via an electrical connection 205*c* and may also be electrically connected and/or interfaced with other internal and/or external circuitry via the electrical connection 205*c*. In an embodiment, the output of the negative peak follower 316 may be electrically connected to the input of a fourth buffer 318 via an electrical connection 358. Also in such an embodiment, the output of the fourth buffer 318 may be electrically connected to the input of a fifth low-pass filter 320 via an electrical connection 360. Additionally, in such an embodiment, the output of the fifth low-pass filter 320 may be electrically connected to a second input of the differential amplifier 322 via an electrical connection 205*d* and may also be electrically connected and/or interfaced with other internal and/or external circuitry via the electrical connection 205*d*. Furthermore, in such an embodiment, the output of the differential amplifier 322 may be electrically connected and/or interfaced with internal and/or external circuitry via an electrical connection 205*e*.

Figure 4A:
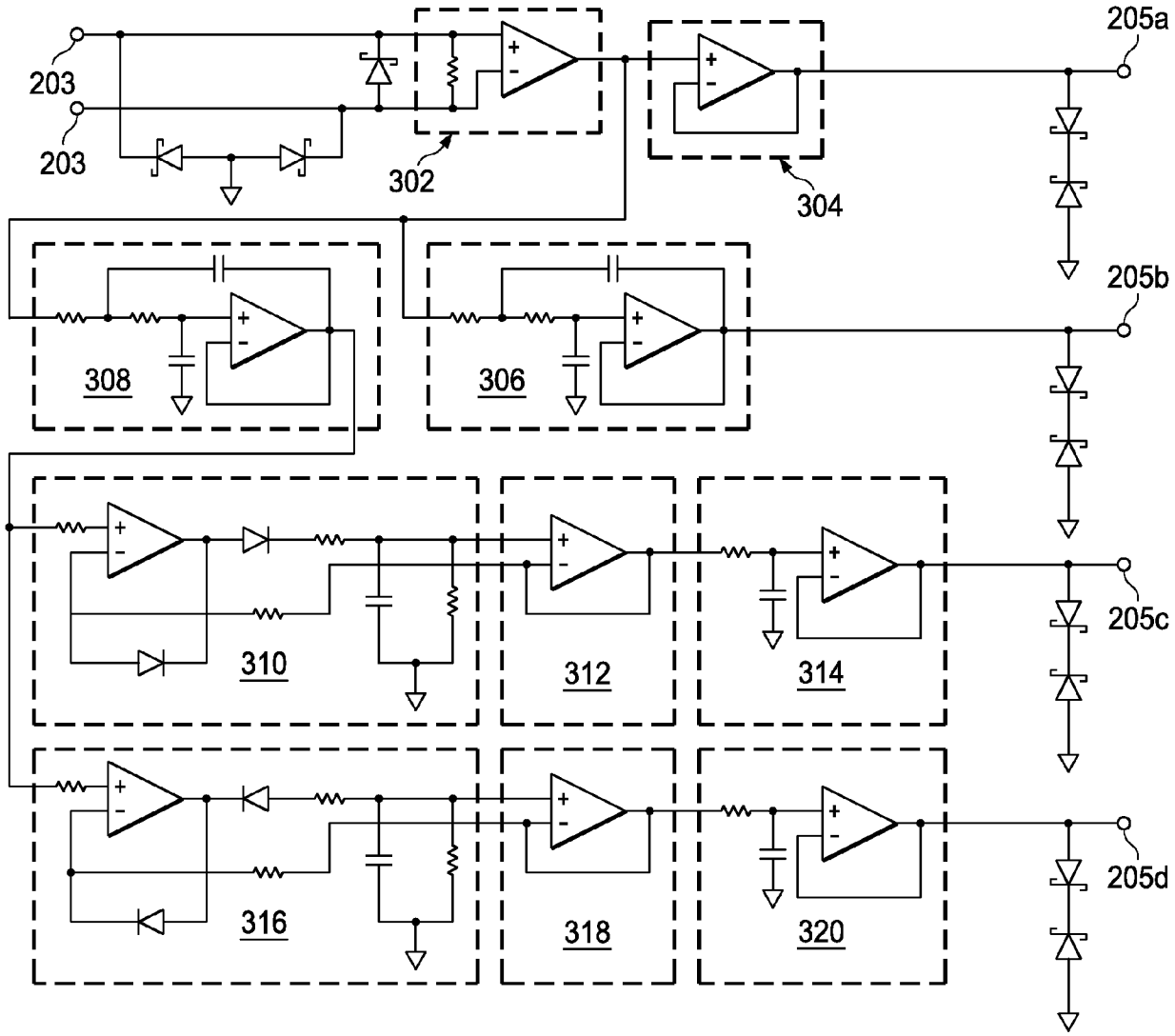
FIG. 4A is a schematic view of a first part of an electronic circuit implementation for a portion of a discharge pressure monitoring system.
Figure 4B:
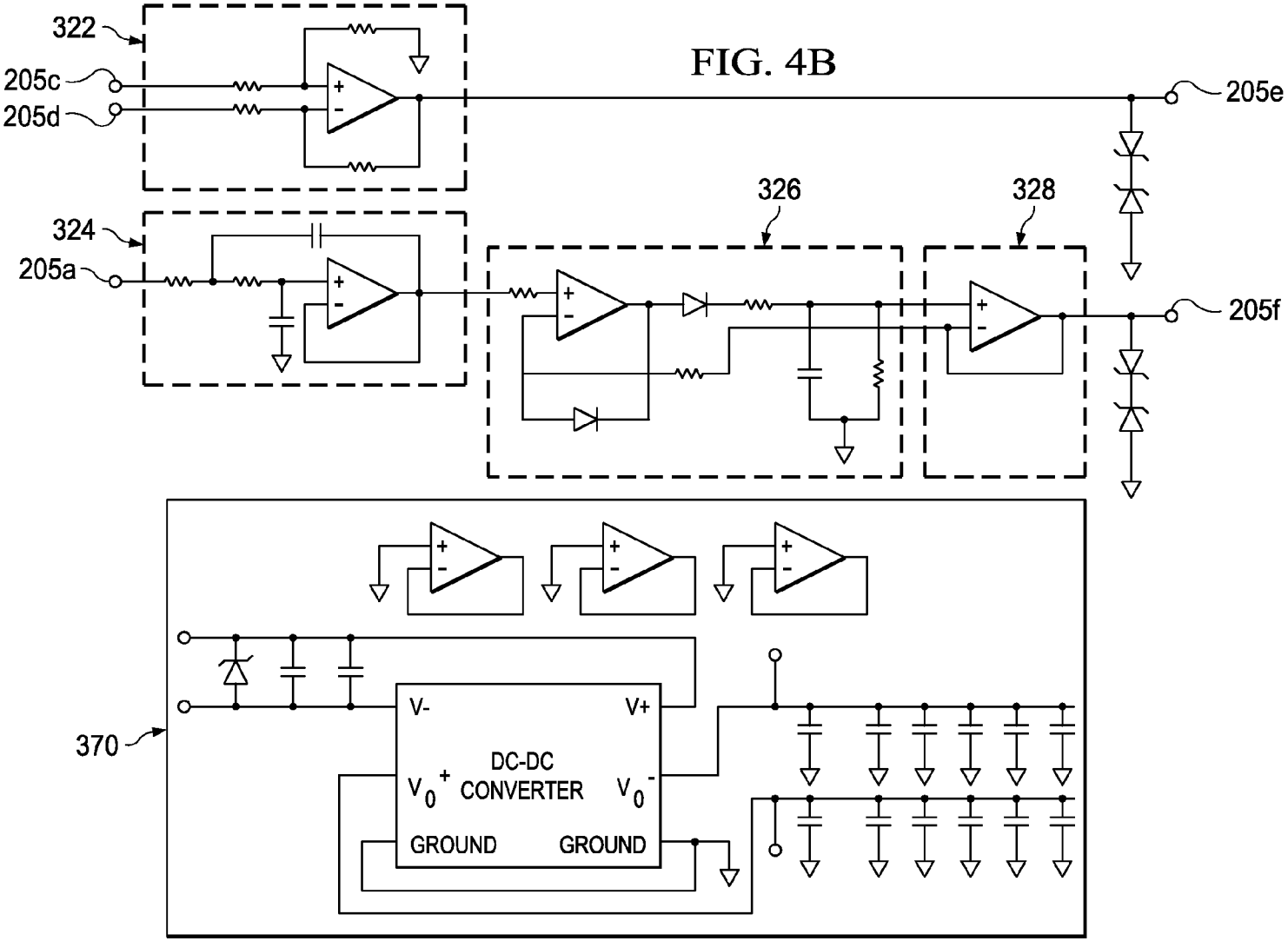
FIG. 4B is a schematic view of a second part an electronic circuit implementation for a portion of a discharge pressure monitoring system.

In the embodiments of FIG. 4A and FIG. 4B, an implementation of the electronic circuit 300 is illustrated. It is noted that in such an embodiment the circuit level implementation is provided for illustrative purposes and that a person of skilled in the relevant arts will recognize suitable alternative embodiment, configurations, and/or arrangements of such functional units which may be similarly employed. Any such functional unit embodiments may conceivably serve as elements of the disclosed implementation.

Figure 5:
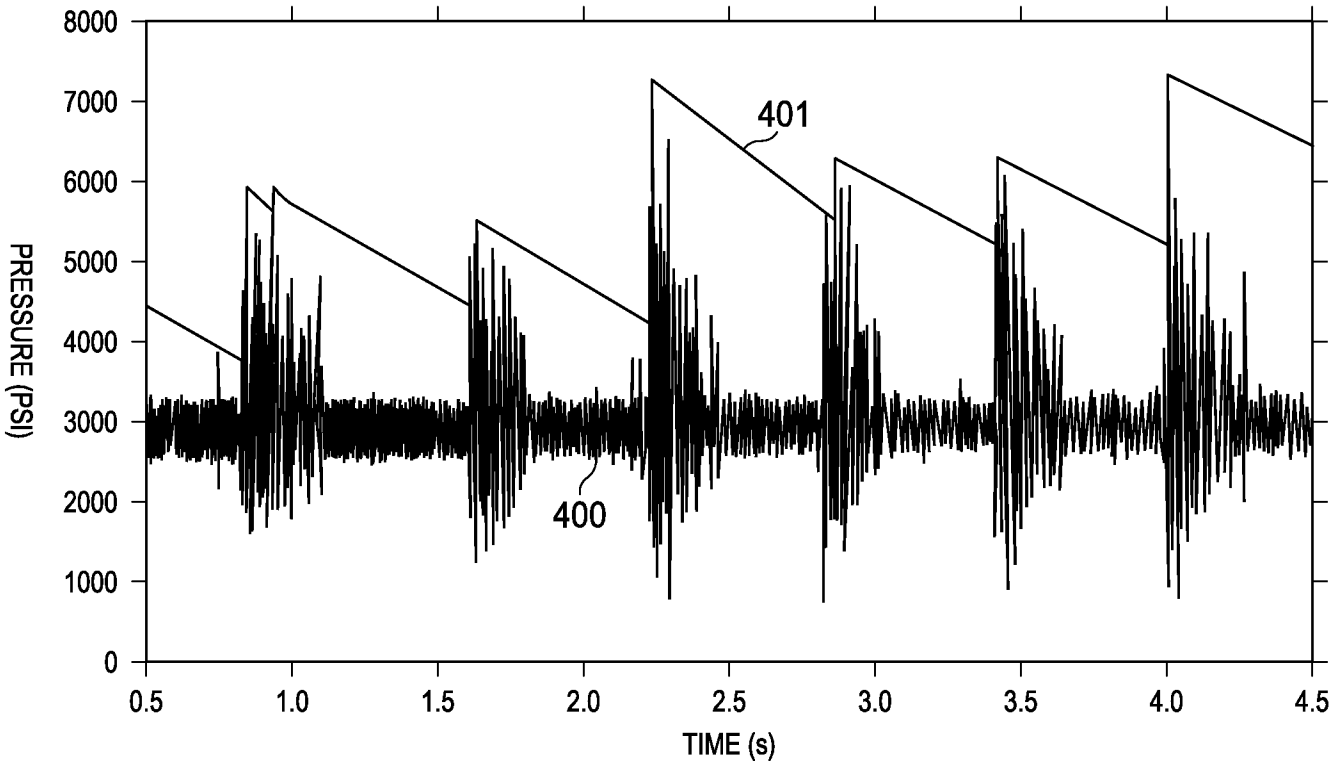
FIG. 5 is a plot of a pressure signal over a period of time measured by a pressure sensor.

In an embodiment, the amplifier 302 may be electrically connected to the transducer 204 (e.g., via the electrical connection 203). In such an embodiment, the amplifier 302 may be configured to receive an electrical signal (e.g., a voltage signal, a current signal) proportional to a pressure sensed by the transducer 204, for example, a signal 400 as illustrated in FIG. 5, and to output an amplified electrical signal. In such an embodiment, the amplifier may be configured to cause the electrical signal to experience a gain, for example, a voltage gain, and thereby proportionally increase the voltage level of the electrical voltage signal. Additionally or alternatively, in an embodiment, the amplifier 302 may be further configured to convert a voltage signal to a current signal (e.g., a transconductance amplifier) or a current signal to a voltage signal (e.g., a transmimpedance amplifier) before or after applying a gain to the electrical signal. Not intending to be bound by theory, applying a gain factor of greater than one to the electrical signal may increase the voltage range over which the analog voltage signal can vary or swing, thereby improving the resolution and/or detectability of small variations of the electrical signal. For example, the electrical signal may experience a gain by a factor of about 100, alternatively, by a factor of about 1,000, alternatively, by a factor of about 10,000, alternatively, by a factor of about 100,000, or any other suitable gain factor. For example, a voltage signal may experience a gain of about 1,000 and the voltage swing of the voltage signal may increase from about 1 millivolt (mV) to about 1 V.

In the embodiment of FIG. 4A, the output signal of the transducer 204 may comprise a differential analog current signal. In such an embodiment, the amplifier 302 may comprise a pair of transimpedance differential input ports (e.g., a first electrical signal input and an inverse of the first electrical signal input), for example, an instrumentation amplifier. In such an embodiment, the amplifier 302 may be configured to convert the current signal to a voltage signal and to apply a voltage gain to the difference between the first electrical signal and the inverse of the first electrical signal and yielding an amplified electrical signal, thereby increasing the voltage swing of the voltage signal. For example, the voltage swing of the voltage signal may increase from about 1 mV to about 1V.

In an embodiment, the first buffer 304 may be configured to receive the amplified electrical signal from the amplifier 302 via the electrical connection 350 and to output a buffered signal. In such an embodiment, the first buffer 304 may be configured to apply a unity gain (e.g., a gain of about one) to the amplified electrical signal and/or to reduce distortion (e.g., signal attenuation) of the amplified electrical signal. Not intending to be bound by theory, the first buffer 304 may be configured to provide a high input impedance, to reduce the amount of current drawn from a source to drive a load, and to supply a sufficient current to drive load, thereby providing an output signal substantially similar to the input signal.

In an embodiment, the first buffer 304 may comprise an operational amplifier (OPAMP) having a differential input (e.g., a non-inverting input and an inverting input). In an embodiment, the OPAMP may be configured such that the amplified electrical signal enters the non-inverting input of the OPAMP. Additionally, in an embodiment, the OPAMP may further comprise a negative feedback connection between the inverting input of the OPAMP and the output of the OPAMP. In such an embodiment, the operational amplifier may be configured to apply a gain of about 1 to the amplified electrical signal, thereby generating the buffered signal.

In an embodiment, the second low-pass filter 324 may be configured to receive the buffered signal from the first buffer 304 via the electrical connection 205*a* and to output a filtered buffer signal. In such an embodiment, the second low-pass filter 324 may be configured to limit the bandwidth of an electrical signal and/or to remove and/or substantially reduce the frequency content of the buffered signal above a predetermined cut-off frequency, thereby generating the filtered buffer signal. For example, in an embodiment, the second low-pass filter 324 may have a cut-off frequency at about 3 Hertz (Hz) and may be configured to remove and/or to substantially reduce any frequencies above 3 Hz within an electronic signal as it passes through the second low-pass filter 324, thereby reducing the bandwidth of the buffered signal. In an alternative embodiment, the second low-pass filter 324 may have a cut-off frequency at about 10 Hz, alternatively, at about 60 Hz, alternatively, at about 100 Hz, alternatively, at about 500 Hz, alternatively, at about 1 kHz, alternatively, at about 10 kHz, alternatively, at about 100 kHz, or at any other suitable frequency as would be appreciated by one of ordinary skill in the art, upon viewing this disclosure.

In an embodiment, the second low-pass filter 324 may comprise an OPAMP and a resistor-capacitor (RC) feedback network. Additionally, in an embodiment, the OPAMP may comprise a differential input (e.g., a non-inverting input and an inverting input). In an embodiment, the OPAMP may comprise a feedback connection (e.g., a connection between the non-inverting input of the OPAMP and the output of the OPAMP) via the RC network and a negative feedback connection (e.g., a connection between output of the OPAMP and the inverting input of the OPAMP). Additionally, in such an embodiment, the RC feedback network may be configured to remove and/or to substantially reduce the frequency content above a predetermined cut-off frequency within the electronic signal (e.g., the buffered signal), thereby filtering out higher frequency (e.g., noise). For example, in an embodiment, the RC network may be configured as a Butterworth low-pass filter with a predetermined cut-off frequency of about 500 Hz.

In an embodiment, the first positive peak follower 326 may be configured to receive the filtered buffer signal from the second low-pass filter 324 via the electrical connection 362 and to output a first upper envelope signal. In an embodiment, the first positive peak follower 326 may be configured to track and/or temporarily store the local maxima values (e.g., peak values) of the filtered buffer signal and may generate the first upper envelope signal, as will be disclosed herein. For example, the first positive peak follower 326 may be configured to track the magnitude of the local maxima values of the filtered buffer signal as the filtered buffer signal passes through the first positive peak follower 326 and to output a voltage signal or a current signal representative of the magnitude of the local maxima values of the filtered electrical signal which decays over time proportional to an RC time constant, as will be disclosed herein.

In an embodiment, the first positive peak follower 326 may comprise an OPAMP having a differential input (e.g., a non-inverting input and an inverting input), one or more resistors, one or more diodes, and one or more capacitors. In an embodiment, the OPAMP may be configured such that the filtered buffer signal enters the non-inverting input of the OPAMP via a resistive connection (e.g., a resistor). Additionally, in an embodiment, the OPAMP may comprise a negative feedback connection between the non-inverting input of the OPAMP and the output of the OPAMP via a diode and resistor feedback network. In such an embodiment, the diode and resistor feedback network may be configured to output a voltage signal or a current signal (e.g., a rectified signal) when the output of the OPAMP exceeds the forward biasing voltage of the one or more diodes. For example, the OPAMP may be configured as a precision rectifier, a half-wave rectifier, a positive peak detector, or the like. Additionally, in such an embodiment, the diode and resistor network may be configured to pass the rectified signal to an RC circuit. In an embodiment, the RC circuit may be configured such that the rectified signal charges one or more capacitors, thereby generating the upper envelope signal. In such an embodiment, the charge stored on/by the one or more capacitors may decay (e.g., exit and/or leak from the one or more capacitors) over time at a rate proportional to an RC time constant established by the resistance and the capacitance of the one or more resistors and the one or more capacitors of the RC circuit. For example, in an embodiment, the RC circuit may be configured such that the charge of the rectified signal stored on/by the one or more capacitors of the RC circuit remains present for a suitable duration of time to be processed by additional circuitry, as will be disclosed herein. For example, suitable durations of time may be about 10 millisecond (ms), alternatively, about 25 ms, alternatively, about 50 ms, alternatively, about 100 ms, alternatively, about 200 ms, alternatively, about 500 ms, alternatively, about 1 second (s), alternatively, about 2 s, alternatively, about 5 s, alternatively, about 10 s, alternatively, any other suitable duration of time, as would be appreciated by one of ordinary skill in the art upon viewing this disclosure.

In an embodiment, the second buffer 328 may be configured to receive the first upper envelope signal from the first positive peak follower 326 via the electrical connection 364 and to output a buffered first upper envelope signal. In such an embodiment, the first buffer 312 may be configured to apply a unity gain (e.g., a gain of about 1) to the first upper envelope signal and/or to reduce distortion of the first upper envelope signal, similarly to what has been previously disclosed, for example, as similarly disclosed with respect to the first buffer 304.

In an embodiment, the second buffer 328 may comprise an OPAMP having a differential input (e.g., a non-inverting input and an inverting input). In an embodiment, the OPAMP may be configured such that the first upper envelope signal enters the non-inverting input of the OPAMP. Additionally, in an embodiment, the OPAMP may further comprise a negative feedback connection between the inverting input of the OPAMP and the output of the OPAMP. In such an embodiment, the operational amplifier may be configured to apply a gain of about 1 to the first upper envelope signal, thereby generating the buffered first upper envelope signal, for example a second signal 401, as illustrated in FIG. 5.

In an embodiment, the first low-pass filter 306 may be configured to receive the amplified electrical signal from the amplifier 302 via the electrical connection 350 and to output an averaged signal. In such an embodiment, the first low-pass filter 306 may be configured to limit the bandwidth of an electrical signal and/or to remove and/or substantially reduce the frequency content of the amplified electrical signal above a predetermined cut-off frequency, thereby generating the averaged signal, similarly to what has been previously disclosed, for example, as similarly disclosed with respect to the second low-pass filter 324.

In such an embodiment, the first low-pass filter 306 may comprise an OPAMP having a differential input (e.g., a non-inverting input and an inverting input) and an RC network. In an embodiment, the OPAMP may comprise a feedback connection (e.g., a connection between the non-inverting input of the OPAMP and the output of the OPAMP) via the RC network and a negative feedback connection (e.g., a connection between output of the OPAMP and the inverting input of the OPAMP). In such an embodiment, the RC feedback network may be configured to remove and/or to substantially reduce the frequency content above a predetermined cut-off frequency within the amplified electronic signal, thereby filtering out higher frequency (e.g., noise). For example, in an embodiment, the RC network may be configured as a Butterworth low-pass filter with a predetermined cut-off frequency of about 3 Hz.

In an additional or alternative embodiment, the third low-pass filter 308 may be configured to receive the amplified electrical signal from the amplifier 302 via the electrical connection 350 and to output a filtered electrical signal. In such an embodiment, the third low-pass filter 308 may be configured to limit the bandwidth of an electrical signal and/or to remove and/or substantially reduce the frequency content of the amplified electrical signal above a predetermined cut-off frequency, thereby generating the averaged signal, similarly to what has been previously disclosed for example, as similarly disclosed with respect to the second low-pass filter 324.

In such an embodiment, the third low-pass filter 308 may comprise an OPAMP having a differential input (e.g., a non-inverting input and an inverting input) and an RC network. In an embodiment, the OPAMP may comprise a feedback connection (e.g., a connection between the non-inverting input of the OPAMP and the output of the OPAMP) via the RC network and a negative feedback connection (e.g., a connection between output of the OPAMP and the inverting input of the OPAMP). In such an embodiment, the RC feedback network may be configured to remove and/or to substantially reduce the frequency content above a predetermined cut-off frequency within the amplified electronic signal, thereby filtering out higher frequency (e.g., noise). For example, in an embodiment, the RC network may be configured as a Butterworth low-pass filter with a predetermined cut-off frequency of about 50 Hz.

In an embodiment, the second positive peak follower 310 may be configured to receive the filtered electrical signal from the third low-pass filter 308 via the electrical connection 352 and to output a second upper envelope signal. In an embodiment, the second positive peak follower 310 may be configured to track and/or temporarily store the local maxima values (e.g., peak values) of the filtered electrical signal and may generate the second upper envelope signal, as will be disclosed herein. For example, the second positive peak follower 310 may be configured to track the magnitude of the local maxima values of the filtered electrical signal as the filtered electrical signal passes through the second positive peak follower 310 and to output a voltage signal or a current signal representative of the magnitude of the local maxima values of the filtered electrical signal which decays over time proportional to an RC time constant, similarly to what has been previously disclosed, for example, as similarly disclosed with respect to the first positive peak follower 326.

In an embodiment, the second positive peak follower 310 may comprise an OPAMP having a differential input (e.g., a non-inverting input and an inverting input), one or more resistors, one or more diodes, and one or more capacitors. In an embodiment, the OPAMP may be configured such that the filtered electrical signal enters the non-inverting input of the OPAMP via a resistive connection (e.g., a resistor). Additionally, in an embodiment, the OPAMP may comprise a negative feedback connection between the non-inverting input of the OPAMP and the output of the OPAMP via a diode and resistor feedback network. In such an embodiment, the diode and resistor feedback network may be configured to output a voltage signal or a current signal (e.g., a rectified signal) when the output of the OPAMP exceeds the forward biasing voltage of the one or more diodes. For example, the OPAMP may be configured as a precision rectifier, a half-wave rectifier, a positive peak detector, or the like. Additionally, in such an embodiment, the diode and resistor network may be configured to pass the rectified signal to an RC circuit. In an embodiment, the RC circuit may be configured such that the rectified signal charges one or more capacitors, thereby generating the second upper envelope signal, similarly as previously disclosed, for example, as similarly disclosed with respect to the first positive peak follower 326.

In an embodiment, the third buffer 312 may be configured to receive the second upper envelope signal from the second positive peak follower 310 via the electrical connection 354 and to output a buffered second upper envelope signal. In such an embodiment, the third buffer 312 may be configured to apply a unity gain (e.g., a gain of about 1) to the second upper envelope signal and/or to reduce distortion (e.g., signal attenuation) of the second upper envelope signal.

In an embodiment, the third buffer 312 may comprise an OPAMP having a differential input (e.g., a non-inverting input and an inverting input). In an embodiment, the OPAMP may be configured such that the second upper envelope signal enters the non-inverting input of the OPAMP. Additionally, in an embodiment, the OPAMP may further comprise a negative feedback connection between the inverting input of the OPAMP and the output of the OPAMP. In such an embodiment, the operational amplifier may be configured to apply a gain of about 1 to the second upper envelope signal, thereby generating the buffered second upper envelope signal.

In an embodiment, the fourth low-pass filter 314 may be configured to receive the buffered second upper envelope signal from the third buffer 312 via the electrical connection 356 and to output a filtered second upper envelope signal. In such an embodiment, the fourth low-pass filter 314 may be configured to limit the bandwidth of an electrical signal and/or to remove and/or substantially reduce the frequency content of the buffered second upper envelope signal above a predetermined cut-off frequency, thereby generating the filtered second upper envelope signal, similarly to what has been previously disclosed, for example, as similarly disclosed with respect to the second low-pass filter 324.

In such an embodiment, the fourth low-pass filter 314 may comprise an OPAMP having a differential input (e.g., a non-inverting input and an inverting input) and an RC network. In an embodiment, the fourth low-pass filter 314 may comprise a negative feedback connection (e.g., a connection between the inverting input of the OPAMP and the output of the OPAMP) and may be configured such that buffered second upper envelope signal enters the non-inverting input of the OPAMP via the RC network. In such an embodiment, the RC feedback network may be configured to remove and/or to substantially reduce the frequency content above a predetermined cut-off frequency within the electronic signal, thereby filtering out higher frequency (e.g., noise) and generating the filtered second upper envelope signal. For example, in an embodiment, the RC network may be configured as a first order active low-pass filter (e.g., a single pole filter response) with a predetermined cut-off frequency of about 50 Hz.

Additionally, in an embodiment, the negative peak follower 316 may be configured to receive the filtered electrical signal from the third low-pass filter 308 via an electrical connection 352 and to output a lower envelope signal. In an embodiment, the negative peak follower 316 may be configured to track and/or temporarily store the local minima values (e.g., minimum values) of the filtered electrical signal and may generate the lower envelope signal, as will be disclosed herein. For example, the negative peak follower 316 may be configured to track the magnitude of the local minima values of the filtered electrical signal as the filtered electrical signal passes through the negative peak follower 316 and to output a voltage signal or current signal representative of the magnitude of the local minima values of the filtered electrical signal which decays over time proportional to an RC time constant, as will be disclosed herein.

In an embodiment, the negative peak follower 316 may comprise an OPAMP having a differential input (e.g., a non-inverting input and an inverting input), one or more resistors, one or more diodes, and one or more capacitors. In an embodiment, the OPAMP may be configured such that the filtered electrical signal enters the non-inverting input of the OPAMP via a resistive connection (e.g., a resistor). Additionally, in an embodiment, the OPAMP may comprise a negative feedback connection between the non-inverting input of the OPAMP and the output of the OPAMP via a diode and resistor feedback network. In such an embodiment, the diode and resistor feedback network may be configured to output a voltage signal or a current signal (e.g., a second rectified signal) when the output of the OPAMP is at about or below a threshold of voltage required to forward bias the one or more diodes. For example, the OPAMP may be configured as a precision rectifier, a half-wave rectifier, a negative peak detector, or the like. Additionally, in such an embodiment, the diode and resistor network may be configured to pass the second rectified signal to an RC circuit. In an embodiment, the RC circuit may be configured such that the second rectified signal charges one or more capacitors, thereby generating the lower envelope signal. In such an embodiment, the charge stored on/by the one or more capacitors may decay (e.g., exit and/or leak from the one or more capacitors) over time at a rate proportional to an RC time constant established by the resistance and the capacitance of the one or more resistors and the one or more capacitors of the RC circuit, similarly to what has previously been disclosed. For example, in an embodiment, the RC circuit may be configured such that the charge of the second rectified signal stored on/by the one or more capacitors of the RC circuit remains present for a suitable duration to be processed by additional circuitry.

In an embodiment, the fourth buffer 318 may be configured to receive the lower envelope signal from the negative peak follower 316 via the electrical connection 358 and to output a buffered lower envelope signal. In such an embodiment, the fourth buffer 318 may be configured to apply a unity gain (e.g., a gain of about 1) to the lower envelope signal and/or to reduce distortion (e.g., signal attenuation) of the lower envelope signal, similarly as previously disclosed, for example, as similarly disclosed with respect to the first buffer 304.

In an embodiment, the fourth buffer 318 may comprise an OPAMP having a differential input (e.g., a non-inverting input and an inverting input). In an embodiment, the OPAMP may be configured such that the lower envelope signal enters the non-inverting input of the OPAMP. Additionally, in an embodiment, the OPAMP may further comprise a negative feedback connection between the inverting input of the OPAMP and the output of the OPAMP. In such an embodiment, the operational amplifier may be configured to apply a gain of about 1 to the lower envelope signal, thereby generating the buffered lower envelope signal.

In an embodiment, the fifth low-pass filter 320 may be configured to receive the buffered lower envelope signal from the fourth buffer 318 via the electrical connection 360 and to output a filtered lower envelope signal. In such an embodiment, the fifth low-pass filter 320 may be configured to limit the bandwidth of an electrical signal and/or to remove and/or substantially reduce the frequency content of the buffered lower envelope signal above a predetermined cut-off frequency, thereby generating the filtered lower envelope signal, similarly to what has been previously disclosed for example, as similarly disclosed with respect to the second low-pass filter 324.

In such an embodiment, the fifth low-pass filter 320 may comprise an OPAMP having a differential input (e.g., a non-inverting input and an inverting input) and an RC network. In an embodiment, the fifth low-pass filter 320 may comprise a negative feedback connection (e.g., a connection between the inverting input of the OPAMP and the output of the OPAMP) and may be configured such that buffered lower envelope signal enters the non-inverting input of the OPAMP via the RC network. In such an embodiment, the RC feedback network may be configured to remove and/or to substantially reduce the frequency content above a predetermined cut-off frequency within the electronic signal, thereby filtering out higher frequency (e.g., noise) and generating the filtered lower envelope signal. For example, in an embodiment, the RC network may be configured as a first order active low-pass filter with a predetermined cut-off frequency of about 50 Hz.

In an embodiment, the differential amplifier 322 may be configured to receive the filtered second upper envelope signal from the fourth low-pass filter 314 and the filtered lower envelope signal from the fifth low-pass filter 320. Additionally, the differential amplifier 322 may be configured to output a differential signal, as will be disclosed herein. For example, in an embodiment, the differential amplifier 322 may be configured to apply a gain to the difference between the filtered second upper envelope and the filtered lower envelope. In such an embodiment, the differential amplifier 322 may be configured to apply a gain factor of about 100, alternatively, a gain factor of about 1,000, alternatively, a gain factor of about 10,000, alternatively, a gain factor of about 100,000, or any other suitable gain factor. Additionally, the differential amplifier 322 may also be configured to remove and/or substantially reduce noise (e.g., thermal noise, white noise) from the difference between the filtered upper envelope signal and the filtered lower envelope signal, for example, substantially reducing common mode noise and/or differential mode noise.

In an embodiment as illustrated in FIG. 4B, the differential amplifier 322 may comprise OPAMP having a differential input (e.g., a non-inverting input and an inverting input) and one or more resistors. In such an embodiment, the differential amplifier 322 may be configured to receive the filtered second upper envelope signal on the non-inverting input of the OPAMP via a first resistive network connection (e.g., one or more resistors) and to receive the filtered lower envelope signal on the inverting input of the OPAMP via a second resistive network (e.g., one or more resistors). Additionally, in an embodiment, the OPAMP comprises a negative feedback connection between the non-inverting input of the OPAMP and the output of the OPAMP via the second resistive network connection (e.g., one or more resistors). In an embodiment, the differential amplifier 322 may be configured to apply a gain factor (e.g., a gain factor of about 1000) the difference between the non-inverting input and the inverting input, thereby increasing the voltage swing of a resulting signal and generating the differential signal.

In an embodiment, the differential amplifier 322 may comprise a dual input differential operational amplifier and one or more resistor networks. In such an embodiment, the differential amplifier 322 may apply a voltage gain (e.g., a voltage gain of 1,000) to the difference between an analog voltage signal on the inverting input terminal and an analog voltage signal on the non-inverting input terminal.

In an embodiment, the electronic circuit 300 may be configured to be supplied with electrical power via a voltage power source, for example, the power source 156. In an additional or alternative embodiment, the wellbore services manifold trailer 195 may further comprise an on-board battery, a power generation device, or combinations thereof. In such an embodiment, the power source and/or the power generation device may supply power to the electric circuit 300, to the transducer 204, or combinations thereof, for example, for the purpose of operating the electric circuit 300, to the transducer 204, or combinations thereof. In an additional or alternative embodiment, the electronic circuit 300 may further comprise voltage regulating circuitry 370 (e.g., zener diodes, DC to DC converters, one or more capacitors) and may be configured to stabilize and/or regulate the electrical power supplied to the electronic circuit 300.

In an embodiment, the DMPS 100 may comprise monitoring equipment 206. In such an embodiment, the monitoring equipment 206 may be electrically connected to the electronic circuit 300 via one or more of the electrical connections 205*a*-205*f*. In an embodiment, the monitoring system 206 may generally comprise a computer, a data acquisition system, a digital signal processor, one or more electrical gauges, one or more mechanical gauges, one or more electromechanical gauges, and/or any other suitable equipment as would be appreciated by one of ordinary skill in the art upon viewing this disclosure.

For example, in an embodiment, the monitoring equipment 206 may comprise a computer system with a memory device (e.g., a hard drive). In such an embodiment, the monitoring equipment 206 may be configured to store collected data from the electronic circuit 300 into the memory device. In an embodiment, the monitoring system 206 may further comprise one or more software applications capable of visualizing and/or processing the collected data (e.g., the buffered signal, the averaged signal, the buffered upper envelope signal, the filtered upper envelope, the filtered lower envelope signal, the differential signal) from the electronic circuit 300.

Figure 6:
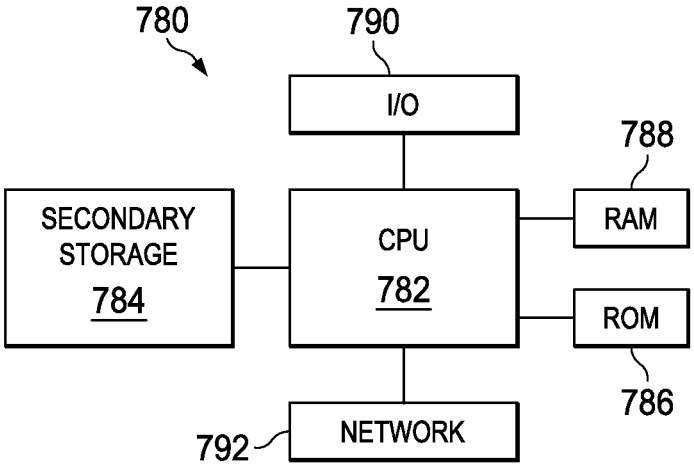
FIG. 6 is a schematic view of an embodiment of a computer system.

For example, FIG. 6 illustrates a computer system 780 suitable for implementing one or more embodiments disclosed herein. The computer system 780 includes a processor 782 (which may be referred to as a central processor unit or CPU) that is in communication with memory devices including secondary storage 784, read only memory (ROM) 786, random access memory (RAM) 788, input/output (I/O) devices 790, and network connectivity devices 792. The processor 782 may be implemented as one or more CPU chips.

It is understood that by programming and/or loading executable instructions onto the computer system 780, at least one of the CPU 782, the RAM 788, and the ROM 786 are changed, transforming the computer system 780 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 784 is typically comprised of one or more disk drives or tape drives and is used for non-volatile storage of data and as an over-flow data storage device if RAM 788 is not large enough to hold all working data. Secondary storage 784 may be used to store programs which are loaded into RAM 788 when such programs are selected for execution. The ROM 786 is used to store instructions and perhaps data which are read during program execution. ROM 786 is a non-volatile memory device which typically has a small memory capacity relative to the larger memory capacity of secondary storage 784. The RAM 788 is used to store volatile data and perhaps to store instructions. Access to both ROM 786 and RAM 788 is typically faster than to secondary storage 784. The secondary storage 784, the RAM 788, and/or the ROM 786 may be referred to in some contexts as computer readable storage media and/or non-transitory computer readable media.

I/O devices 790 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 792 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 792 may enable the processor 782 to communicate with an Internet or one or more intranets. With such a network connection, it is contemplated that the processor 782 might receive information from the network, or might output information to the network in the course of performing the above-described method steps. Such information, which is often represented as a sequence of instructions to be executed using processor 782, may be received from and outputted to the network, for example, in the form of a computer data signal embodied in a carrier wave.

Such information, which may include data or instructions to be executed using processor 782 for example, may be received from and outputted to the network, for example, in the form of a computer data baseband signal or signal embodied in a carrier wave. The baseband signal or signal embodied in the carrier wave generated by the network connectivity devices 792 may propagate in or on the surface of electrical conductors, in coaxial cables, in waveguides, in an optical conduit, for example an optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 782 executes instructions, codes, computer programs, scripts which it accesses from hard disk, floppy disk, optical disk (these various disk based systems may all be considered secondary storage 784), ROM 786, RAM 788, or the network connectivity devices 792. While only one processor 782 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 784, for example, hard drives, floppy disks, optical disks, and/or other device, the ROM 786, and/or the RAM 788 may be referred to in some contexts as non-transitory instructions and/or non-transitory information.

In an embodiment, the computer system 780 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 780 to provide the functionality of a number of servers that is not directly bound to the number of computers in the computer system 780. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 780, at least portions of the contents of the computer program product to the secondary storage 784, to the ROM 786, to the RAM 788, and/or to other non-volatile memory and volatile memory of the computer system 780. The processor 782 may process the executable instructions and/or data structures in part by directly accessing the computer program product, for example by reading from a CD-ROM disk inserted into a disk drive peripheral of the computer system 780. Alternatively, the processor 782 may process the executable instructions and/or data structures by remotely accessing the computer program product, for example by downloading the executable instructions and/or data structures from a remote server through the network connectivity devices 792. The computer program product may comprise instructions that promote the loading and/or copying of data, data structures, files, and/or executable instructions to the secondary storage 784, to the ROM 786, to the RAM 788, and/or to other non-volatile memory and volatile memory of the computer system 780.

In some contexts, a baseband signal and/or a signal embodied in a carrier wave may be referred to as a transitory signal. In some contexts, the secondary storage 784, the ROM 786, and the RAM 788 may be referred to as a non-transitory computer readable medium or a computer readable storage media. A dynamic RAM embodiment of the RAM 788, likewise, may be referred to as a non-transitory computer readable medium in that while the dynamic RAM receives electrical power and is operated in accordance with its design, for example during a period of time during which the computer 780 is turned on and operational, the dynamic RAM stores information that is written to it. Similarly, the processor 782 may comprise an internal RAM, an internal ROM, a cache memory, and/or other internal non-transitory storage blocks, sections, or components that may be referred to in some contexts as non-transitory computer readable media or computer readable storage media.

In an additional or alternative embodiment, the monitoring equipment 206 may comprise a data acquisition system configured to sample and store data from the electronic circuit 300. For example, in an embodiment, the data acquisition system may be configured to sample data at a rate of about 1 kS/s and to store the sampled data onto a memory device (e.g., a secure digital (SD) memory card). In an alternative embodiment, the data acquisition system may sample data at a rate of about 100 kS/s, alternatively, at a rate of about 200 kS/s, alternatively, at a rate of about 500 kS/s, alternatively, at a rate of about 2 kS/s, alternatively, at a rate of about 100 kS/s, alternatively, at a rate of about 1 MS/s, or at about any suitable sample rate as would be appreciated by one of ordinary skill in the art upon viewing this disclosure.

In an additional or alternative embodiment, the monitoring equipment 206 may comprise a digital signal processor (DSP). In such an embodiment, the DSP may be a stand-alone unit or used in conjunction with other monitoring equipment (e.g., a computer). In an embodiment, the DSP may comprise internal hardware and/or software and may be configured to analyze or to further process the data from the transducer 204 and/or the electronic circuit 300. For example, in an embodiment, the DSP may be configured to apply one or more frequency filters (e.g., out-of-band noise filtering, in-band noise filtering, windowing) and/or to perform mathematical operations (e.g., addition, subtraction, integration, differentiation) to the data from the electronic circuit 300.

In an additional or alternative embodiment, the monitoring equipment 206 may comprise one or more electrical gauges, one or more mechanical gauges, and/or one or more electromechanical gauges. For example, in an embodiment, the monitoring equipment may comprise one or more electromechanical gauges and may interface one or more of the electromechanical gauges with the electronic circuit 300 via one or more of the electrical connections 205*a*-205*f*. For example, in an embodiment, the one or more electromechanical gauges may comprise a mechanical wiper arm configured to pivot about a dial face proportional to and/or indicative of the electronic signal received from the electronic circuit 300.

In an additional or alternative embodiment, the DPMS 100, for example, monitoring equipment 206, may further comprise an electrical connection to the hydraulic control system 160. For example, in such an embodiment, the monitoring equipment 206 may be configured to provide data used for controlling one or more boost pumps 126 and/or one or more high-pressure pumps 142 via one or more of the output signals of the monitoring equipment 206.

In an embodiment, a pressure monitoring method utilizing the DPMS 100 and/or a system comprising a DPMS 100 is disclosed herein. In an embodiment, a pressure monitoring method may generally comprise the steps of providing a wellbore servicing system 500 comprising a DPMS 100 and one or more pumps (e.g., one or more high-pressure pumps) comprising a fluid discharge flow path, collecting data (e.g., pressure data) from the one or more pumps of the wellbore servicing system 500, monitoring the data from the one or more pumps of the wellbore servicing system 500, and responding when an over pressure occurs, as will be disclosed herein. In an additional embodiment, a wellbore servicing method may further comprise storing the data from the DPMS 100 and/or further processing and/or analyzing the data from the DPMS 100.

In an embodiment, a wellbore servicing system 500 comprising a wellbore servicing manifold trailer 195 comprising one or more pumps and a DPMS 100 may be transported to a well site, for example, for performing a wellbore servicing operation (e.g., a fracturing operation). In such an embodiment, the wellbore servicing manifold trailer 195 may be positioned at the well site and may be connected to a wellbore head (e.g., via the wellhead connector 150), a blender 100 (e.g., via the blender connection 114), and one or more high-pressure pumps (e.g., via the high-pressure pump suction connector 138 and the high-pressure discharge connector 146).

In an embodiment, collecting data from the wellbore servicing system may generally comprise the steps of placing the transducer 204 of the DPMS 100 in fluid and/or pressure communication with the discharge flow path of the one or more pumps (e.g., one or more high-pressure pumps) of the wellbore servicing system 500, collecting data from the transducer 204 of the DPMS 100, and processing the data from the transducer 204 of the DPMS 100.

In an embodiment, the transducer 204 of the DPMS 100 may be placed in fluid and/or pressure communication with a flow path of a fluid discharge flow path (e.g., flowline 144, flowline 148, and/or flowline 152) of the one or more pumps (e.g., one or more high-pressure pumps 142) of the wellbore servicing system 500 such that the transducer 204 may senses and/or measures the pressure within the fluid discharge flow path of one or more high-pressure pumps 142, for example, during the performance of a wellbore servicing operation. In an alternative embodiment, the transducer 204 may be positioned within an ancillary flow path (e.g., flowline 202) which may be in fluid and/or pressure communication with the fluid discharge flow path (e.g., flowline 144, flowline 148, and/or flowline 152) of the one or more high-pressure pumps 142.

In an additional or alternatively, in an embodiment, the transducer 204 may be placed in fluid and/or pressure communication with a fluid discharge flow path (e.g., flowline 128) such that the transducer 204 senses and/or measures the pressure within the fluid discharge flow path of one or more boost pumps 126. In an alternative embodiment, the transducer 204 may be positioned within an ancillary flow path which may be in fluid and/or pressure communication with the fluid discharge flow path (e.g., flowline 128) of the one or more boost pump 126.

In an alternative embodiment, the DPMS 100 may comprise a plurality of transducers 204. For example, in an embodiment, a plurality of transducers 204 may in fluid and/or pressure communication with the fluid discharge flow path (e.g., one or more of the flowlines 128, 144, 148, and/or 152) of one or more boost pumps 126 and/or one or more high-pressure pumps 142.

In an alternative embodiment, the transducer 204 may be positioned within a common fluid discharge flow path (e.g., a manifold such as connector 146) for a plurality of pumps (e.g., a plurality of boost pumps 126 and/or a plurality of high-pressure pumps 142). In such an embodiment, the transducer 204 may be in fluid and/or pressure communication with the plurality of pumps.

In an embodiment, when the wellbore servicing system 500 is configured to communicate a fluid through the one or more pumps (e.g., the boost pumps 126 and/or the high-pressure pumps 142), for example, when performing a wellbore servicing operation, a suitable fluid (e.g., a wellbore servicing fluid) may be communicated through the one or more pumps. Non-limiting examples of a suitable wellbore servicing fluid include but are not limited to a fracturing fluid, a perforating or hydrojetting fluid, an acidization fluid, the like, or combinations thereof. The wellbore servicing fluid may be communicated at a rate and/or pressure sufficient to perform the wellbore servicing operation.

In an embodiment, as a fluid is communicated through the one or more pumps, the transducer 204 measures the pressure within the fluid discharge flow path of the one or more pumps. For example, in an embodiment, the transducer 204 may measure the pressure within the fluid discharge flow path and covert the measured pressure into an electrical signal indicative of the measured pressure to be processed by the electronic circuit 300.

In an alternative embodiment, where the transducer 204 is in fluid and/or pressure communication with the fluid discharge flow path of one or more pumps via an ancillary flow path, as a fluid is communicated through the one or more pumps, the transducer 204 measures the pressure within the fluid discharge flow path of the one or more pumps. Additionally, in such an embodiment, the transducer 204 may covert the measured pressure into an electrical signal indicative of the measured pressure to be processed by the electronic circuit 300.

In an embodiment, where the transducer 204 outputs an electrical signal indicative of the measured pressure within the fluid discharge flow path of one or more pumps, the electronic circuit 300 processes the electrical signal and generates, various pressure-related data which may include, for example, the buffered first upper envelope signal and the buffered signal, as previously disclosed, or combinations thereof.

In an additional or alternative embodiment, the performance of the wellbore servicing system 500 may be monitored for events, such as over-pressure, of or within one or more pumps, during the wellbore servicing operation. In an embodiment, one or more of the electronic circuit 300 output signals (e.g., the buffered first upper envelope signal and the buffered signal) may be monitored during a wellbore servicing operation. In an embodiment, the buffered first upper envelope signal may be referenced against a predetermined upper pressure threshold, for example, the predetermined upper pressure threshold may be a maximum operating pressure for one or more pumps (e.g., the one or more high-pressure pumps 142 and/or the one or more boost pumps 126) and/or one or more wellbore servicing equipment components (e.g., steel pipe, flowlines, connectors, seals, etc.).

In an embodiment, the first upper envelope signal may be referenced against an upper pressure threshold, for example, the maximum operating pressure for one or more pumps (e.g., one or more high-pressure pumps 142, one or more boost pumps 126, and/or any other component in the wellbore servicing system 500). In an additional or alternative embodiment, a stored data history of the first upper envelope signal may be compared to the upper threshold during post processing analysis.

For example, in an embodiment, during operation in the event that the first upper envelope signal exceeds the upper pressure threshold, the electronic circuit 300 and/or the monitoring equipment 206 may transmit a control signal to suspend or reduce wellbore servicing operations. For example, in an embodiment, when the first upper envelope signal exceeds the upper pressure threshold the DPMS 100 may suspend wellbore servicing operations until further actions are taken (e.g., an equipment inspection). In an alternative embodiment, when the first upper envelope signal exceeds the upper pressure threshold the DPMS 100 may reduce the flow rate and/or speed of one or more pumps, for example, one or more pumps may set to a neutral or an idle operating flow rate and/or speed. For example, the DPMS 100 may engage a clutch between a power supply and one or more pumps or may otherwise bring one or more pumps and/or power supplies into a neutral state.

In an additional or alternative embodiment, during operation when the first upper envelope signal exceeds the upper pressure threshold the electronic circuit 300 and/or the monitoring equipment 206 may trigger an alarm, for example, an visible indicator (e.g., a light) and/or an audible indicator (e.g., a siren).

In an embodiment, the electronic circuits 300 may be connected to an electromechanical gauge for monitoring during a wellbore servicing operation. In an additional or alternative embodiment, the electronic circuits 300 may be connected to a computer comprising monitoring and/or data processing software. In an additional or alternative embodiment, the electronic circuits 300 may be connected to a data acquisition system for data storage and/or for further future processing and analysis.

In an additional or alternative embodiment, one or more electrical signals (e.g the buffered first upper envelope signal and the buffered signal) from the electronic circuit 300 may be stored onto a memory device (e.g., a computer hard drive). For example, in an embodiment, the filtered upper envelope signal may be stored onto a computer hard drive and compared to the predetermined upper pressure threshold during a post processing analysis.

In an additional or alternative embodiment, one or more of the electronic circuit 300 output signals (e.g the buffered first upper envelope signal and the buffered signal) may be transmitted to a remote location, for example, for monitoring a wellbore servicing operation remotely. For example, in an embodiment, the wellbore servicing system 500 may further comprise one or more wireless network components (e.g., a transmitter, a router, a modem, an antenna, etc.) and a wireless connection (e.g., a Wifi connection, a cellular network connection, etc.).

In an additional or alternative embodiment, the differential signal may be analyzed for substantial pressure variations of one or more pumps, for example, the magnitude of the differential signal may be monitored and/or recorded. For example, in an embodiment, the magnitude of the differential signal may be monitored and/or compared to a predetermined maximum magnitude threshold. In an additional or alternative embodiment, the magnitude of the differential signal may be monitored to avoid developing beat frequencies between one or more pumps. In an additional or alternative embodiment, the buffered signal may be monitored to provide about real-time pressure data for one or more pumps. In an additional or alternative embodiment, the averages signal may be monitored to provide the average pressure of one or more pumps over a period of time.

In an embodiment, a DPMS 100, a system comprising a DPMS 100, and/or a discharge pressure monitoring method employing a system and/or a DPMS 100, as disclosed herein or in some portion thereof, may be advantageously employed during wellbore servicing operation. For example, in an embodiment, a DPMS like DPMS 100 enables the discharge line pressure for one or more pumps to be measured and processed during operation and/or the discharge line pressure for one or more pumps to be stored for later processing. For example, the performance and integrity of one or more pumps and/or of the overall system can be monitored and/or tracked during wellbore servicing operations. As may be appreciated by one of ordinary skill in the art, such methods, as previously disclosed, of performing wellbore servicing operations may provide the capabilities to accurately determine pressure thresholds during rapid changes in pressure such as during over-pressuring.

Additionally, the DPMS 100 enables earlier detection of and/or response to events such as over-pressuring during operation. Conventional methods may rely on mechanical safety valves (e.g., mechanical pop-offs) to relieve pressure when the pressure thresholds exceed safety tolerances. In such cases, the mechanical safety valves may have a mechanical latency and may be unable to respond to rapid pressure spikes such as during over-pressuring. In an embodiment, as previously disclosed, the DPMS 100 provides the ability to detect and track fast transient events (e.g., pressure peaks or spikes), for example, to be processed by a wellbore servicing system. As may be appreciated by one of ordinary skill in the art, such methods, as previously disclosed, of performing wellbore servicing operations may provide the ability to detect and/or locate an over pressure that may have occurred during operation. Conventional methods may require significant down time from wellbore servicing operations. Therefore, the methods disclosed herein provide a means by which performance and/or system integrity can be observed by monitoring the discharge pressure of one or more pumps.

In an embodiment, the wellbore servicing system 500 further comprises a suction pressure monitoring system (SPMS) or the type disclosed in co-pending U.S. patent application Ser. No. 13/720,729 filed on 12/19/2012, which is incorporated by reference herein in its entirety.

Additional Disclosure

The following are non-limiting, specific embodiments in accordance with the present disclosure:

A first embodiment, which is a pressure monitoring method comprising:

- providing wellbore servicing equipment comprising:
  - a pump;
  - a discharge flow path configured to discharge fluid from the pump;
  - a discharge pressure monitoring system comprising:
  - a transducer in pressure communication with the discharge flow path; and
  - an electronic circuit in electrical communication with the transducer and a monitoring system;
- collecting an electrical signal indicative of the pressure within the discharge flow path;
- processing the electrical signal to generate an upper pressure envelope signal, wherein the upper pressure envelope signal is representative of a high pressure within the discharge flow path over a predetermined duration of time; and
- comparing the upper pressure envelope signal to a predetermined upper threshold.

A second embodiment, which is the pressure monitoring method of the first embodiment, wherein collecting the electrical signal indicative of the pressure within the discharge flow path comprises sampling the pressure within the discharge flow path with the transducer.

A third embodiment, which is the pressure monitoring method of one of the first through the second embodiments, wherein processing the electrical signal comprises amplifying, buffering, or filtering the electrical signal.

A fourth embodiment, which is the pressure monitoring method of one of the first through the third embodiments, wherein processing the electrical signal comprises outputting the upper pressure envelope signal.

A fifth embodiment, which is the pressure monitoring method of one of the first through the fourth embodiments, wherein the electronic circuit communicates with a control system coupled to the pump.

A sixth embodiment, which is the pressure monitoring method of one of the first through the fifth embodiments, further comprising responding when the upper pressure envelope signal is greater than the predetermined threshold.

A seventh embodiment, which is the pressure monitoring method of the sixth embodiment, wherein the flow rate of one or more pumps is reduced in response to the upper pressure envelope signal exceeding the upper threshold.

An eighth embodiment, which is the pressure monitoring method of the sixth embodiment, wherein an alarm is triggered in response to the upper pressure envelope signal exceeding the upper threshold.

A ninth embodiment, which is the pressure monitoring method of one of the first through the eighth embodiments, therein processing the electrical signal comprises:

receiving an electrical signal;

amplifying the electrical signal, thereby yielding an amplified electrical signal;

filtering the amplified electrical signal, thereby producing a filtered electrical signal; and tracking an upper threshold of the filtered electrical signal, thereby yielding the upper pressure envelope signal.

A tenth embodiment, which is a wellbore servicing system comprising:

a pump;

a discharge flow path configured to discharge fluid from the pump;

a discharge pressure monitoring system comprising:

a transducer in pressure communication with the discharge flow path; and an electronic circuit in electrical communication with the transducer and a monitoring system, wherein the electronic circuit is configured to generate an upper pressure envelope signal, wherein the upper pressure envelope signal is representative of a high pressure within the discharge flow path over a predetermined duration of time.

An eleventh embodiment, which is the wellbore servicing system of the tenth embodiment, wherein the discharge flow path is associated with a single pump.

A twelfth embodiment, which is the wellbore servicing system of one of the tenth through the eleventh embodiments, wherein the discharge flow path is associated with a plurality of pumps.

A thirteenth embodiment, which is the wellbore servicing system of one of the tenth through the twelfth embodiments, wherein the transducer is a pressure sensor.

A fourteenth embodiment, which is the wellbore servicing system of one of the tenth through the thirteenth embodiments, wherein the transducer yields an electrical signal, wherein the electrical signal is indicative of the pressure within the discharge flow path.

A fifteenth embodiment, which is the wellbore servicing system of the fourteenth embodiment, wherein the electronic circuit is configured to perform one or more signal processing operations with respect to the electrical signal from the transducer.

A sixteenth embodiment, which is the wellbore servicing system of one of the tenth through the fifteenth embodiments, wherein the electronic circuit comprises an analog filter, a resistor and capacitor network, or one or more integrated circuits.

A seventeenth embodiment, which is the wellbore servicing system of the sixteenth embodiment, wherein the one or more integrated circuits comprise an operational amplifier.

An eighteenth embodiment, which is the wellbore servicing system of one of the tenth through the seventeenth embodiments, wherein the wellbore servicing system further comprises an analog to digital converter or a digital signal processor coupled to the electronic circuit.

A nineteenth embodiment, which is the wellbore servicing system of one of the tenth through the eighteenth embodiments, wherein the monitoring equipment comprises a computer, a data acquisition system, a digital signal processor, or one or more electromechanical gauges coupled to the electronic circuit.

A twentieth embodiment, which is a pressure monitoring method comprising:

providing a discharge flow path from a pump;

collecting an electrical signal indicative of the pressure within the discharge flow path;

processing the electrical signal to generate an upper pressure envelope signal, wherein the upper pressure envelope signal is representative of a high pressure within the discharge flow path over a predetermined duration of time;

monitoring upper pressure envelope signal; and responding when the upper pressure envelope signal exceeds a predetermined upper threshold.

A twenty-first embodiment, which is the pressure monitoring method of the twentieth embodiment, wherein processing the electrical signal comprises:

receiving an electrical signal;

amplifying the electrical signal, thereby yielding an amplified electrical signal;

filtering the amplified electrical signal, thereby producing a filtered electrical signal; and tracking an upper threshold of the filtered electrical signal, thereby yielding the upper pressure envelope signal.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A pressure monitoring method comprising:

providing wellbore servicing equipment comprising:

a pump;

a discharge flow path configured to discharge fluid from the pump;

a discharge pressure monitoring system comprising:

a transducer coupled to the discharge flow path, wherein the transducer is in pressure communication with the discharge flow path;

and an electronic circuit in electrical communication with the transducer and a monitoring system;

collecting an electrical signal at the discharge flow path, wherein the electrical signal is indicative of the pressure within the discharge flow path;

processing the electrical signal to generate an upper pressure envelope signal, further comprising:

tracking a local maximum value of the electrical signal;

outputting a representative signal of the local maximum value of the electrical signal, wherein the representative signal decays over time proportional to a time constant;

and wherein the upper pressure envelope signal is representative of a high pressure within the discharge flow path over a predetermined duration of time; and comparing the upper pressure envelope signal to a predetermined upper threshold.

2. The pressure monitoring method of claim 1, wherein collecting the electrical signal indicative of the pressure within the discharge flow path comprises sampling the pressure within the discharge flow path with the transducer.

3. The pressure monitoring method of claim 1, wherein processing the electrical signal comprises amplifying, buffering, or filtering the electrical signal.

4. The pressure monitoring method of claim 1, wherein processing the electrical signal comprises outputting the upper pressure envelope signal.

5. The pressure monitoring method of claim 1, wherein the electronic circuit communicates with a control system coupled to the pump.

6. The pressure monitoring method of claim 1, further comprising responding when the upper pressure envelope signal is greater than the predetermined threshold.

7. The pressure monitoring method of claim 6, wherein the flow rate of one or more pumps is reduced in response to the upper pressure envelope signal exceeding the upper threshold.

8. The pressure monitoring method of claim 6, wherein an alarm is triggered in response to the upper pressure envelope signal exceeding the upper threshold.

9. The pressure monitoring method of claim 1, wherein processing the electrical signal comprises:

receiving an electrical signal;

amplifying the electrical signal, thereby yielding an amplified electrical signal;

filtering the amplified electrical signal, thereby producing a filtered electrical signal; and tracking an upper threshold of the filtered electrical signal, thereby yielding the upper pressure envelope signal.

10. A pressure monitoring method comprising:

providing a discharge flow path from a pump;

collecting an electrical signal at the discharge flow path, wherein the electrical signal is indicative of the pressure within the discharge flow path;

processing the electrical signal to generate an upper pressure envelope signal, further comprising:

tracking a local maximum value of the electrical signal;

outputting a representative signal of the local maximum value of the electrical signal, wherein the representative signal decays over time proportional to a time constant;

and wherein the upper pressure envelope signal is representative of a high pressure within the discharge flow path over a predetermined duration of time;

monitoring the upper pressure envelope signal; and responding when the upper pressure envelope signal exceeds a predetermined upper threshold.

11. The pressure monitoring method of claim 10, wherein processing the electrical signal comprises:

receiving an electrical signal;

amplifying the electrical signal, thereby yielding an amplified electrical signal;

filtering the amplified electrical signal, thereby producing a filtered electrical signal; and tracking an upper threshold of the filtered electrical signal, thereby yielding the upper pressure envelope signal.

* * * * *